US006638161B2

(12) United States Patent
Soltys et al.

(10) Patent No.: US 6,638,161 B2
(45) Date of Patent: Oct. 28, 2003

(54) METHOD, APPARATUS AND ARTICLE FOR VERIFYING CARD GAMES, SUCH AS PLAYING CARD DISTRIBUTION

(75) Inventors: Richard Soltys, Bellevue, WA (US); Richard Huizinga, Bellevue, WA (US)

(73) Assignee: MindPlay LLC, Bellevue, WA (US)

( * ) Notice: Subject to any disclaimer, the term of this patent is extended or adjusted under 35 U.S.C. 154(b) by 0 days.

(21) Appl. No.: 10/017,277

(22) Filed: Dec. 13, 2001

(65) Prior Publication Data

US 2002/0155869 A1 Oct. 24, 2002

Related U.S. Application Data

(63) Continuation-in-part of application No. 09/790,480, filed on Feb. 21, 2001.

(60) Provisional application No. 60/296,866, filed on Jun. 8, 2001.

(51) Int. Cl.[7] ..... A63F 13/00

(52) U.S. Cl. ..... 463/12; 463/22; 463/11; 273/138.2; 273/292

(58) Field of Search ..... 463/10–13, 16–22, 463/47; 273/138.1, 138.2, 143 R, 139, 148 R, 309, 292

(56) References Cited

U.S. PATENT DOCUMENTS

| | | | | |
|---|---|---|---|---|
| 4,531,187 A | 7/1985 | Uhland | 364/412 |
| 4,711,452 A | 12/1987 | Dickinson et al. | 273/143 R |
| 5,050,881 A | 9/1991 | Nagao | 273/143 R |
| 5,374,061 A | 12/1994 | Albrecht | 273/149 R |
| 5,397,133 A | 3/1995 | Penzias | 273/439 |
| 5,431,399 A | 7/1995 | Kelley | 273/149 P |
| 5,586,936 A | 12/1996 | Bennett et al. | 463/25 |
| 5,605,334 A | 2/1997 | McCrea, Jr. | 273/309 |
| 5,605,504 A | 2/1997 | Huang | 463/22 |
| 5,613,912 A | 3/1997 | Slater | 463/25 |
| 5,704,835 A | 1/1998 | Dietz, II | 463/20 |
| 5,711,525 A | 1/1998 | Breeding | 273/292 |

(List continued on next page.)

FOREIGN PATENT DOCUMENTS

| | | |
|---|---|---|
| DE | 44 39 502 C 1 | 9/1995 |
| WO | WO00/62880 | 10/2000 |

*Primary Examiner*—Mark Sager
*Assistant Examiner*—Aaron Capron
(74) *Attorney, Agent, or Firm*—Seed IP Law Group PLLC

(57) ABSTRACT

One or more actual hands of playing cards are verified against respective expected hands of playing cards, to determine whether the playing cards actually dealt correspond to the playing cards that should have been dealt based on a starting sequence of playing card values. The starting sequence of playing card values can be computationally pseudo-randomly generated, where playing cards will be ordered, for example by printing or sorting, according to the sequence for distribution to the player and/or dealer. The starting sequence of playing card values can be determined by reading identifiers from a number of playing cards prior to dealing.

42 Claims, 15 Drawing Sheets

U.S. PATENT DOCUMENTS

| | | | | |
|---|---|---|---|---|
| 5,722,893 | A | 3/1998 | Hill et al. | 463/47 |
| 5,735,525 | A | 4/1998 | McCrea, Jr. | 273/309 |
| 5,735,742 | A | 4/1998 | French | 463/25 |
| 5,770,533 | A | 6/1998 | Franchi | 463/42 |
| 5,772,505 | A | 6/1998 | Garczynski et al. | 463/12 |
| 5,779,546 | A | 7/1998 | Meissner et al. | 463/25 |
| 5,785,321 | A | 7/1998 | van Putten et al. | 273/309 |
| 5,788,573 | A | 8/1998 | Baerlocher et al. | 463/16 |
| 5,801,766 | A | 9/1998 | Alden | 348/157 |
| 5,803,809 | A | 9/1998 | Yoseloff | 463/13 |
| 5,809,482 | A | 9/1998 | Strisower | 705/30 |
| 5,842,921 | A | 12/1998 | Mindes et al. | 463/16 |
| 5,909,876 | A | 6/1999 | Brown | 273/309 |
| 5,911,626 | A | 6/1999 | McCrea, Jr. | 463/27 |
| 5,919,090 | A | 7/1999 | Mothwurf | 463/25 |
| 5,941,769 | A | 8/1999 | Order | 463/12 |
| 5,941,771 | A | 8/1999 | Haste, III | 463/17 |
| 5,947,820 | A | 9/1999 | Morro et al. | 463/9 |
| 5,967,893 | A | 10/1999 | Lawrence et al. | 463/10 |
| 5,989,122 | A | 11/1999 | Roblejo | 463/22 |
| 6,004,207 | A | 12/1999 | Wilson, Jr. et al. | 463/20 |
| 6,010,404 | A | 1/2000 | Walker et al. | 463/21 |
| 6,027,115 | A | 2/2000 | Griswold et al. | 273/143 R |
| 6,039,650 | A | 3/2000 | Hill | 463/47 |
| 6,062,981 | A | 5/2000 | Luciano, Jr. | 463/26 |
| 6,113,492 | A | 9/2000 | Walker et al. | 463/16 |
| 6,117,009 | A | 9/2000 | Yoseloff | 463/20 |
| 6,126,166 | A | 10/2000 | Lorson et al. | 273/148 R |
| 6,159,096 | A | 12/2000 | Yoseloff | 463/20 |
| 6,162,121 | A | 12/2000 | Morro et al. | 463/16 |
| 6,165,069 | A | 12/2000 | Sines et al. | 463/12 |
| 6,168,520 | B1 | 1/2001 | Baerlocher et al. | 463/16 |
| 6,186,892 | B1 | 2/2001 | Frank et al. | 463/19 |
| 6,227,971 | B1 | 5/2001 | Weiss | 463/20 |
| 6,299,536 | B1 | 10/2001 | Hill | 463/47 |
| 6,313,871 | B1 | 11/2001 | Schubert | 348/143 |
| 2002/0147042 | A1 * | 10/2002 | Vuong et al. | 463/40 |

* cited by examiner

METHOD, APPARATUS AND ARTICLE FOR VERIFYING CARD GAMES, SUCH AS PLAYING CARD DISTRIBUTION

BACKGROUND OF THE INVENTION

1. Technical Field

This invention is generally related to games of skill and chance, and in particular to playing card games.

2. Description of the Related Art

Card games are a well-known form of recreation and entertainment. Games are typically played with one or more decks of cards, where each deck typically includes 52 cards. Each deck of cards will typically include four suits of cards, including: hearts, diamonds, clubs, and spades, each suit including fourteen cards having rank: 2–10, Jack, Queen, King and Ace. Card games may, or may not, include wagering based on the game's outcome.

One popular card game is known as blackjack. In blackjack, one or more players each compete against a dealer. The players attempt to collect a hand having a total point value equal to, or as close to twenty-one, without going over. The point value of the hand is determined by the rank of the card. Thus, cards having rank 2–10 have the point value 2–10, respectively. Face cards (i.e., Jack, Queen, King) have the point value 10, while Aces can have the point value 1 or 11 at the player's discretion. An initial hand of two cards having a point value of twenty-one (i.e., an Ace plus a ten or a face card) is referred to as a natural "21", or blackjack, and beats other hands with the point value of twenty-one. Suits have no bearing on the game of blackjack.

In blackjack, the dealer initially deals two cards to each of the players in two passes around the table, starting with the player at the dealer's far left (i.e., first base), extending through the player at the dealer's far right (i.e., third base) and finally to the dealer's self. The players' cards are dealt face up in games where the cards are dealt from a shoe, and face down in hand-held games (i.e., games dealt by hand). The rules of play for the dealer are strictly dictated, leaving almost no decisions up to the dealer. Thus, the dealer, and other players, can see the other player's hands without effecting the outcome of the game.

The dealer turns over or is dealt one of the dealer's first two cards face up (i.e., top card), the rank of the card visible to the players at the table. The dealer leaves or is dealt the second card face down (i.e., hole card), the rank of the card not visible to the players at the table. In some variations of blackjack, the dealer will immediately determine the point value of the hole card, while in other variations of the game the dealer waits until all players have played their hands before checking the point value of the hole card.

The dealer then offers each player, in succession from the dealer's left to right, the opportunity to accept additional cards. Each player's hand is completed before the dealer offers the next player the opportunity to receive additional cards. Accepting cards is commonly referred to as "hitting" or taking a "hit." At each player's turn, the player may accept cards, one at a time, trying to build a hand with a point value as close to twenty-one as possible, without going over twenty-one. The player may decline further cards at anytime, which is commonly referred to as "standing." The player's hand is immediately terminated if its point value exceeds twenty-one, which is commonly referred to as a "bust" or "busted." If the player busts, or has a natural twenty-one (i.e., blackjack), the dealer completes the player's hand and place that player's cards into a discard holder. Before receiving a third card after the initial hands are dealt, a player can split the player's initial hand. This is commonly referred to as splitting. The player uses one of the initial cards to form a new hand, placing a wager for the new hand, and retains the other of the initial cards as a part of the original hand.

After each player in turn has declined to accept further cards, the dealer may accept further cards from the deck. Casinos have rules based on the point value of the dealer's hand that dictate when the dealer must take an additional card from the deck (i.e., hit) and when the player must decline further additional cards (i.e., stand). For example, many casinos require the dealer to stand if the dealer's hand has a point value of seventeen or more. Some, casinos permit the dealer to take an additional card if the point value of the dealer's hand is a soft seventeen, that is, if the point value of the dealer's hand is seventeen by counting an Ace held by the dealer as eleven.

If the dealer busts, players who have not also busted win. If the dealer does not bust, all remaining players and the dealer must display their hands to allow the dealer to compare each of the player's hands to the dealer's hand. Those players having a hand with a higher point value than the dealer's hand, and who have not exceed twenty-one win. The winning players are paid based on the size of their wager and the odds. The wagers of losing players are collected, and the dealer collects the cards remaining on the table in a particular order. Blackjack includes additional rules such as "doubling down" and "insurance" bets, and other variations that are commonly known by those who play blackjack, and will not be further described in the interest of brevity.

Card games, such as twenty-one, are particularly popular in casinos and other gaming establishments. Players wager large sums of money while playing. Thus, it is important to ensure that those playing the game are not cheating. It is also important to monitor the game in a relatively unobtrusive manner to allow casino customers to feel comfortable in their surroundings.

Decks of playing cards must be periodically shuffled to prevent the cards from continually reappearing in the same order. Shuffling may also interfere with, and even prevent, a player from gaining an unfair advantage by counting cards. Numerous card counting systems are known, and typically rely on a player keeping a mental count of some or all of the cards which have been played. For example, in the game of twenty-one it is beneficial to determine when all cards with a rank of 5 have been dealt (i.e., fives strategy). Since cards with a value of ten favor the player over the house, it is also beneficial to determine the number of cards remaining in the deck(s) having a point value of ten (i.e., Tens strategy). Other variations of card counting are well known in the art. Shuffling may take place after every card in the deck or decks has been dealt, for example after several hands have been played, or may take place more frequently.

Manual shuffling tends to slow play down, so the gaming industry now employs mechanical shufflers to speed up play and to more thoroughly shuffle the cards. The cards are typically shuffled several cards before the end of the deck(s), in an effort to hinder card counting, which is particularly effective when only a few hands of cards remain (i.e., end game strategy). The ratio of the number of cards dealt to the total number of cards remaining in the deck(s) is commonly known as the deck penetration. The gaming industry is now introducing continuous shufflers in a further attempt to frustrate attempts at card counting. As the name implies, continuous shufflers mechanically shuffle the cards remaining to be dealt while one or more hands are being played.

While mechanical shufflers increase the speed of play and produce a more thorough shuffle than manual methods, mechanical shuffling is subject to incomplete shuffles due to the inherently consistent operation of mechanical devices and are limited in the total number of decks they can manipulate.

SUMMARY OF THE INVENTION

Under one aspect, a method of verifying playing card games includes automatically determining an identity of each of a number of playing cards forming a player's completed hand; comparing the identity of each of the number of playing cards from the player's completed hand to an expected set of playing cards for the player's completed hand; and producing a notification if the identity of each of the number of playing card the player's completed hand does not match a respective playing card in the expected set of playing cards for the player's completed hand. In a related aspect, a computer-readable media can store instructions for causing a computer to verify playing card games by the method.

Under another aspect, a method of verifying playing card games employs a computationally generated pseudo-random sequence of playing card values. The method includes determining an expected set of playing card values for the playing card hand based on the computationally generated pseudo-random sequence of playing card values, a number of hands dealt and a relative position of the playing card hand in an order of dealing; and determining whether the identifiers read from each of the number of playing cards forming the hand of playing cards correspond to the expected set of playing card values for the playing card hand. The method can include generating the pseudo-random sequence of playing card values, or can include receiving a generated pseudo-random sequence of playing card values. The method can include reading an identifier from each of a number of playing cards forming a hand of playing cards, or can include receiving the read identifiers. In a related aspect, a computer-readable media can store instructions for causing a computer to verify playing card games by the method.

In another aspect, a method of verifying playing card games employs a read sequence of playing card values. The method includes determining an expected set of playing card values for the playing card hand based on the deck sequence of playing card values, a number of hands dealt and a relative position of the playing card hand in an order of dealing; and determining whether the identifiers read from each of the number of playing cards forming the hand of playing cards correspond to the expected set of playing card values for the playing card hand. The method can include reading in sequence an identifier from each of a number of playing cards from which a card game will be dealt, or can include receiving a read sequence of playing card values corresponding to playing cards from which the card game will be dealt. The method can include reading an identifier from each of a number of playing cards forming a hand of playing cards; or can include receiving a collected sequence of playing card values corresponding to the completed hands of playing cards collected from the players and/or dealer. In a related aspect, a computer-readable media can store instructions for causing a computer to verify playing card games by the method.

In a further aspect, a system for verifying playing card games includes a card interface device for reading, writing and/or printing markings on playing cards. The card interface device can be a stand alone device, or can be networked to a host computing system, server, and/or other electronic components. The card interface device can include a reader such as an optical scanner, optical imager or magnetic sensor for reading identifying markings from playing cards. In some aspects, the card interface device can include one or more printing heads, and/or magnetic or other write heads for printing identifying markings on playing cards. The reader and the printing or writing heads can be located in one housing or in separate housings. In some aspects, the card interface device can include a processor configured to generate a pseudo-random sequence of playing card values, and/or a print head controller for printing or writing markings on the playing cards corresponding to the pseudo-random sequence of playing card values.

BRIEF DESCRIPTION OF THE DRAWINGS

In the drawings, identical reference numbers identify similar elements or acts. The sizes and relative positions of elements in the drawings are not necessarily drawn to scale. For example, the shapes of various elements and angles are not drawn to scale, and some of these elements are arbitrarily enlarged and positioned to improve drawing legibility. Further, the particular shapes of the elements as drawn, are not intended to convey any information regarding the actual shape of the particular elements, and have been solely selected for ease of recognition in the drawings.

DETAILED DESCRIPTION OF THE INVENTION

In the following description, certain specific details are set forth in order to provide a thorough understanding of various embodiments of the invention. However, one skilled in the art will understand that the invention may be practiced without these details. In other instances, well-known structures associated with computers, servers, networks, imagers, and gaming or wagering apparatus have not been shown or described in detail to avoid unnecessarily obscuring descriptions of the embodiments of the invention.

Unless the context requires otherwise, throughout the specification and claims which follow, the word "comprise" and variations thereof, such as, "comprises" and "comprising" are to be construed in an open, inclusive sense, that is as "including, but not limited to."

The headings provided herein are for convenience only and do not interpret the scope or meaning of the claimed invention.

Wagering Environment Overview

Figure 1:
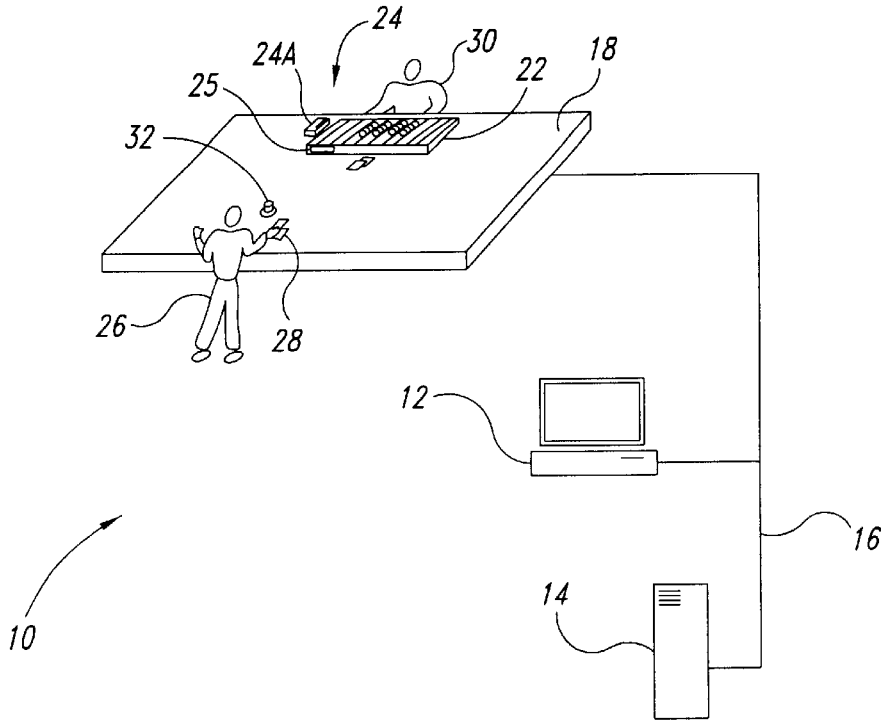
FIG. 1 is an isometric view of a networked automatic wager monitoring system in a gaming environment, including a networked playing card interface device according to one illustrated embodiment of the invention.

FIG. 1 shows a networked automated wager monitoring system 10 including a host computing system 12, a server 14 and a network 16. The server 14 and network 16 couple the host computing system 12 to various gaming sensors, gaming actuators and/or gaming processors at a number of different wagering or gaming tables, such as a twenty-one or blackjack table 18, only one gaming table 18 being shown for clarity of presentation.

In one embodiment, the host computing system 12 acts as a central computing system, interconnecting the gaming tables of one or more casinos. In an alternative embodiment, the host computing system 12 is associated with a single gaming table, or a small group of gaming tables. In a further alternative, the host computing system 12 is associated with a single gaming table or group of gaming tables and is interconnected with other host computing systems.

The gaming sensors, gaming actuators and/or gaming processors and other electronics can be located in the gaming table 18, and/or various devices on the gaming table 18 such as a chip tray 22 and/or a card interface device 24 such as a combined card printing and reading device 24A for printing and reading markings on playing cards. The chip tray 22 can include a card hand reader 25 for reading the dealer's initial hand, or a separately housed card hand reader can be located on or in the gaming table. The structure and operation of the card hand reader is described in commonly assigned U.S. patent applications listed at the end of this specification. Examples of some suitable hardware and software for automating the monitoring and playing of playing card based games, such as twenty-one, are described in commonly assigned pending U.S. patent applications identified at the end of this specification.

A player 26 can place a wager on the outcome of the gaming event, such as the outcome of a hand of playing cards 28 dealt by a dealer 30 in a game of twenty-one, for example, by locating wagering pieces such as one or more chips 32 at an appropriate location on the blackjack table 18.

Figure 2:
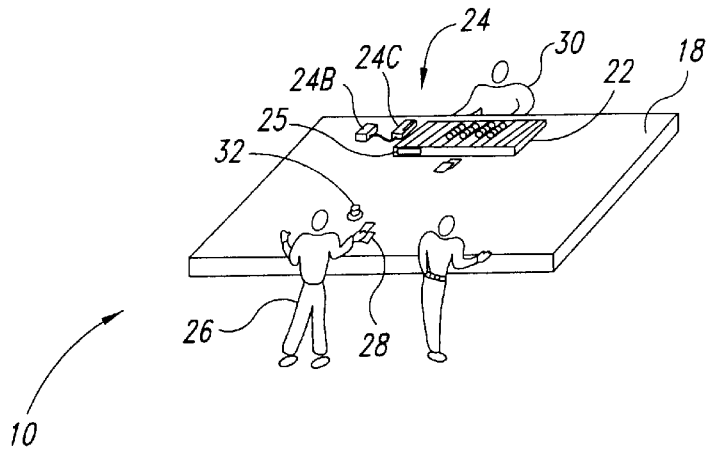
FIG. 2 is an isometric view of a gaming table, including a standalone playing card interface device including a playing card printing device and an associated playing card reading device according to another illustrated embodiment of the invention.

FIG. 2 shows an alternative embodiment of the gaming table 18. This alternative embodiment, and those alternative embodiments and other alternatives described herein, are substantially similar to previously described embodiments, and common acts and structures are identified by the same reference numbers. Only significant differences in operation and structure are described below.

In FIG. 2, the gaming table 18 includes a standalone version of the card interface device 24 which is not networked to a host computing system 12 or server 14. As represented in FIG. 2, the card interface 24 may include a card printing device 24B and a separate card reading device 24C communicatingly coupled to the card printing device 24B. The gaming table 18 does not otherwise employ the electronics of FIG. 1. Thus, the dealer and/or a pit boss manually monitors the game play and wagering.

Alternatively, the networked version (FIG. 1) can employ separately housed card printing and card reading devices, while the standalone version (FIG. 2) can employ integrally housed card printing and card reading devices.

System Hardware

Figure 3:
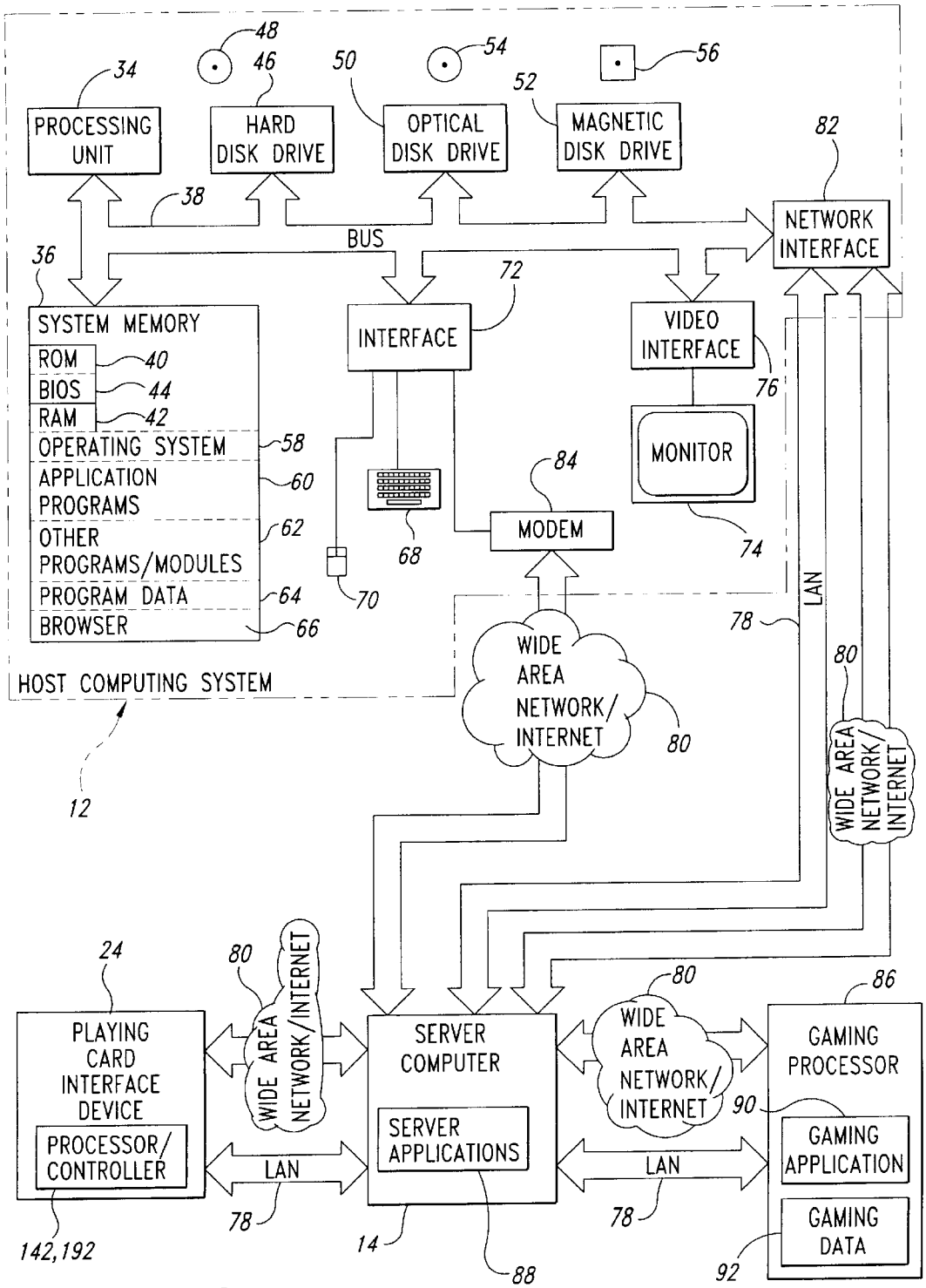
FIG. 3 is a functional block diagram of the networked automatic wager monitoring system of FIG. 1.

FIG. 3 and the following discussion provide a brief, general description of a suitable computing environment in which embodiments of the invention can be implemented, particularly those of FIG. 1. Although not required, embodiments of the invention will be described in the general context of computer-executable instructions, such as program application modules, objects, or macros being executed by a computer. Those skilled in the relevant art will appreciate that the invention can be practiced with other computer system configurations, including hand-held devices, multiprocessor systems, microprocessor-based or programmable consumer electronics, personal computers ("PCs"), network PCs, mini computers, mainframe computers, and the like. The invention can be practiced in distributed computing environments where tasks or modules are performed by remote processing devices, which are linked through a communications network. In a distributed computing environment, program modules may be located in both local and remote memory storage devices.

Referring to FIG. 3, a conventional mainframe or minicomputer, referred to herein as the host computing system 12, includes a processing unit 34, a system memory 36 and a system bus 38 that couples various system components including the system memory 36 to the processing unit 34. The host computing system 12 will at times be referred to in the singular herein, but this is not intended to limit the application of the invention to a single host computer since in typical embodiments, there will be more than one host computer or other device involved. The automated wager monitoring system 10 may employ other computers, such as conventional personal computers, where the size or scale of the system allows. The processing unit 34 may be any logic processing unit, such as one or more central processing units (CPUs), digital signal processors (DSPs), application-specific integrated circuits (ASICs), etc. Unless described otherwise, the construction and operation of the various blocks shown in FIG. 3 are of conventional design. As a result, such blocks need not be described in further detail herein, as they will be understood by those skilled in the relevant art.

The system bus 38 can employ any known bus structures or architectures, including a memory bus with memory controller, a peripheral bus, and a local bus. The system memory 36 includes read-only memory ("ROM") 40 and random access memory ("RAM") 42. A basic input/output system ("BIOS") 44, which can form part of the ROM 40, contains basic routines that help transfer information between elements within the host computing system 12, such as during start-up.

The host computing system 12 also includes a hard disk drive 46 for reading from and writing to a hard disk 48, and an optical disk drive 50 and a magnetic disk drive 52 for reading from and writing to removable optical disks 54 and magnetic disks 56, respectively. The optical disk 54 can be a CD-ROM, while the magnetic disk 56 can be a magnetic floppy disk or diskette. The hard disk drive 46, optical disk drive 50 and magnetic disk drive 52 communicate with the processing unit 34 via the bus 38. The hard disk drive 46, optical disk drive 50 and magnetic disk drive 52 may include interfaces or controllers (not shown) coupled between such drives and the bus 38, as is known by those skilled in the relevant art. The drives 46, 50 and 52, and their associated computer-readable media, provide nonvolatile storage of computer readable instructions, data structures, program modules and other data for the host computing system 12. Although the depicted host computing system 12 employs hard disk 46, optical disk 50 and magnetic disk 52, those skilled in the relevant art will appreciate that other types of computer-readable media that can store data accessible by a computer may be employed, such as magnetic cassettes, flash memory cards, digital video disks ("DVD"), Bernoulli cartridges, RAMs, ROMs, smart cards, etc.

Program modules can be stored in the system memory 36, such as an operating system 58, one or more application programs 60, other programs or modules 62 and program data 64. The system memory 36 may also include a Web client or browser 66 for permitting the host computing system 12 to access and exchange data with sources such as Web sites of the Internet, corporate intranets, or other networks as described below, as well as other server applications on server computers such as those further discussed below. The browser 66 in the depicted embodiment is markup language based, such as Hypertext Markup Language (HTML), Extensible Markup Language (XML) or Wireless Markup Language (WML), and operates with markup languages that use syntactically delimited characters added to the data of a document to represent the structure of the document. A number of Web clients or browsers are commercially available such as NETSCAPE NAVIGATOR from America Online, and INTERNET EXPLORER available from Microsoft of Redmond, Wash.

While shown in FIG. 3 as being stored in the system memory 36, the operating system 58, application programs 60, other programs/modules 62, program data 64 and browser 66 can be stored on the hard disk 48 of the hard disk drive 46, the optical disk 54 of the optical disk drive 50 and/or the magnetic disk 56 of the magnetic disk drive 52. An operator, such as authorized casino personnel, can enter commands and information into the host computing system 12 through input devices such as a keyboard 68 and a pointing device such as a mouse 70. Other input devices can include a microphone, joystick, game pad, scanner, etc. These and other input devices are connected to the processing unit 34 through an interface 72 such as a serial port interface that couples to the bus 38, although other interfaces such as a parallel port, a game port or a wireless interface or a universal serial bus ("USB") can be used. A monitor 74 or other display device is coupled to the bus 38 via a video interface 76, such as a video adapter. The host computing system 12 can include other output devices, such as speakers, printers, etc.

The host computing system 12 can operate in a networked environment using logical connections to one or more remote computers, such as the server computer 14. The server computer 14 can be another personal computer, a server, another type of computer, or a collection of more than one computer communicatively linked together and typically includes many or all of the elements described above for the host computing system 12. The server computer 14 is logically connected to one or more of the host computing systems 12 under any known method of permitting computers to communicate, such as through a local area network ("LAN") 78, or a wide area network ("WAN") or the Internet 80. Such networking environments are well known in wired and wireless enterprise-wide computer networks, intranets, extranets, and the Internet. Other embodiments include other types of communication networks including telecommunications networks, cellular networks, paging networks, and other mobile networks.

When used in a LAN networking environment, the host computing system 12 is connected to the LAN 78 through an adapter or network interface 82 (communicatively linked to the bus 38). When used in a WAN networking environment, the host computing system 12 may include a modem 84 or other device, such as the network interface 82, for establishing communications over the WAN/Internet 80. The modem 84 is shown in FIG. 3 as communicatively linked between the interface 72 and the WAN/Internet 80. In a networked environment, program modules, application programs, or data, or portions thereof, can be stored in the server computer 14. In the depicted embodiment, the host computing system 12 is communicatively linked to the server computer 14 through the LAN 78 or the WAN/Internet 80 with TCP/IP middle layer network protocols; however, other similar network protocol layers are used in other embodiments, such as User Datagram Protocol ("UDP"). Those skilled in the relevant art will readily recognize that the network connections shown in FIG. 3 are only some examples of establishing communication links between computers, and other links may be used, including wireless links.

The server computer 14 is communicatively linked to the sensors, actuators, and gaming processors 86 of one or more gaming tables 18, typically through the LAN 78 or the WAN/Internet 80 or other networking configuration such as a direct asynchronous connection (not shown). The server computer 14 is also communicatively linked to the card interface device 24, typically through the LAN 78 or the WAN/Internet 80 or other networking configuration such as a direct asynchronous connection (not shown).

The server computer 14 includes server applications 88 for the routing of instructions, programs, data and agents between the gaming processors 86 and the host computing system 12. For example the server applications 88 may include conventional server applications such as WINDOWS NT 4.0 Server, and/or WINDOWS 2000 Server, available from Microsoft Corporation or Redmond, Wash. Additionally, or alternatively, the server applications 88 can include any of a number of commercially available Web servers, such as INTERNET INFORMATION SERVICE from Microsoft Corporation and/or IPLANET from Netscape.

The gaming processor 86 can include gaming applications 90 and gaming data 92. The gaming applications 90 can include instructions for acquiring wagering and gaming event information from the live gaming at the game position, such as instructions for acquiring an image of the wagers and identifiers on playing cards. The gaming applications 90 can also include instructions for processing, at least partially, the acquired wagering and gaming event information, for example, identifying the position and size of each wager, the value of each hand of playing cards and/or verifying that the playing cards were dealt in the correct order. Suitable applications are described in one or more of commonly assigned U.S. patent applications listed at the end of this specification.

Additionally, the gaming applications 90 may include statistical packages for producing statistical information regarding the play at a particular gaming table, the performance of one or more players, and/or the performance of the dealer 30 and/or game operator. The gaming applications 90 can also include instructions for providing a video feed of some or all of the gaming position. Gaming data may include outcomes of games, amounts of wagers, average wager, player identity information, complimentary benefits information ("comps"), player performance data, dealer performance data, chip tray accounting information, playing card sequences, etc. The gaming applications 90 can further include instructions for handling security such as password or other access protection and communications encryption. Thus, the server 12 can route wagering related information between the gaming tables and the host computing system 12.

Card Interface Devices

Figure 4:
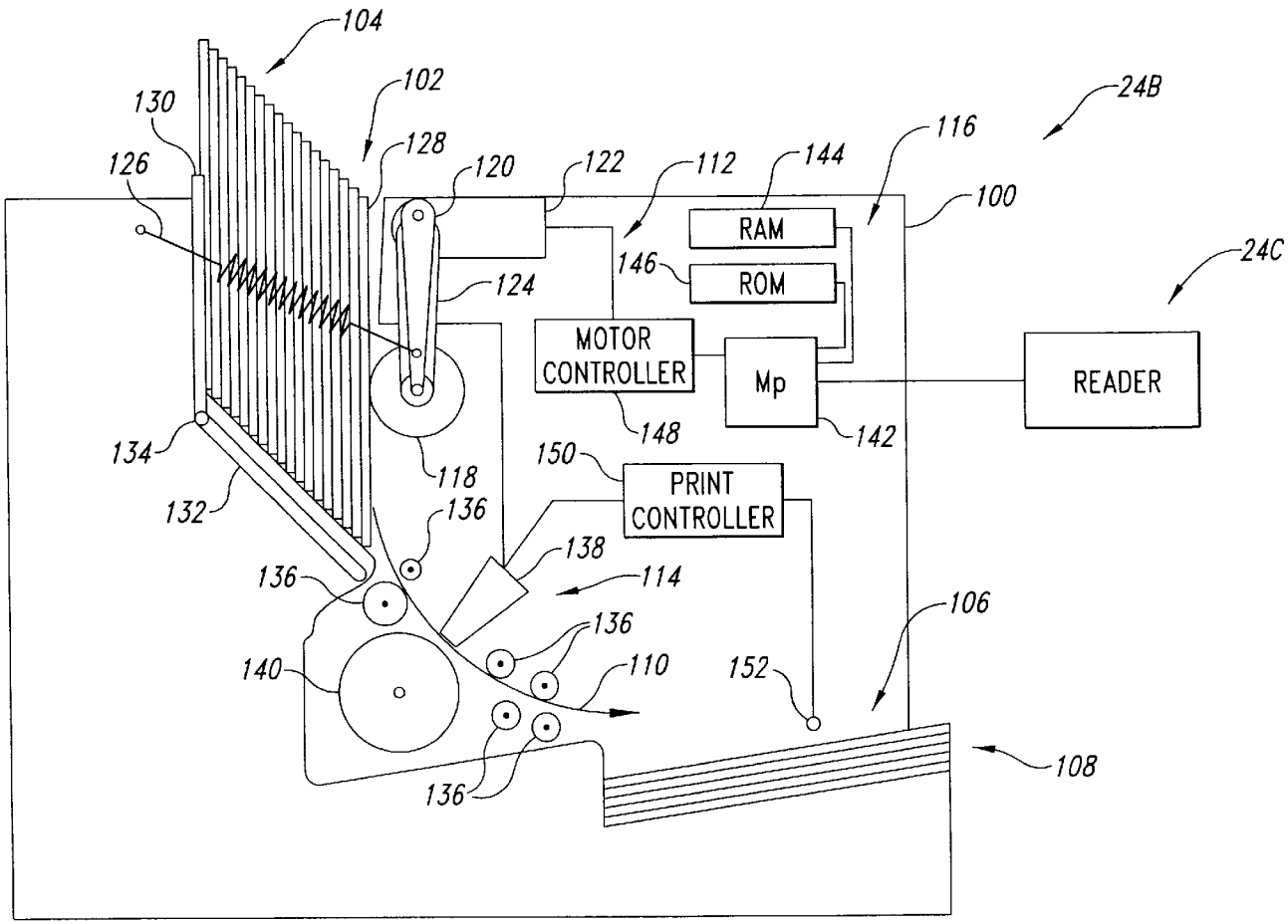
FIG. 4 is a partial cross-sectional diagram of the playing card interface device of FIG. 2 showing various components of the playing card printing device.

FIG. 4 shows one embodiment of the card interface device 24 represented in FIG. 2, in the form of the card printing device 24B and separately housed card reading device 24C communicatingly coupled to the card printing device 24B.

The card printing device 24B includes a housing 100 having a card receiver 102 for receiving playing card blanks 104, a card holder 106 for holding printed playing cards 108, and a card path identified by arrow 110 extending between the card receiver 102 and card holder 106. While shown as separate receptacles 102, 106, some embodiments of the card printing device 24B may employ a single receptacle for both receiving the playing card blanks 104 and the printed playing cards 108. The card printing device 24B generally includes a drive mechanism 112, a print mechanism 114 and a control mechanism 116.

As illustrated in FIG. 4, the drive mechanism 112 includes a drive roller 118 rotatably mounted at the end of a pivot arm 120 and driven by a motor 122 via a drive belt 124. The motor drive the drive roller 118, For example, a stepper motor 122, can drive the drive roller 118 in small increments or steps, such that the card blank 104 is propelled incrementally or stepped through the card path 110 of the card printing device 24B, pausing slightly between each step. Stepper motors and their operation are well-known. A spring 126 biases the pivot arm 120 toward the card blanks 104 to maintain contact between the drive roller 118 and an outer most one 128 of the card blanks 104 in the card receiver 102. Thus, as the drive roller 118 rotates (counterclockwise with respect to the Figure), the outer most card blank 128 is propelled along the card path 110.

Additionally, or alternatively, a card support 130 positioned behind the card blanks 104 is supported along an inclined plane such as a guide channel 132 by one or more rollers 134. The weight of the card support 130 and or an additional attached weight (not shown) biases the card support 130 and the card blanks 104 toward the card path 110. The drive mechanism 112 also includes a number of guide rollers 136 to guide the card blank 104 along the card path 110. Typically the guide rollers 136 are not driven, although in some embodiments one or more of the guide rollers 136 can be driven where suitable. For example, one or more guide rollers 136 may be driven where the card path 110 is longer than the length of the card blank 104. While a particular drive mechanism 112 is illustrated, many other suitable drive mechanisms will be apparent to those skilled in the art of printing, such as the numerous examples of drive mechanisms used in impact and/or non-impact printers.

The printing mechanism 114 includes a print head 138 and a platen 140. The print head 138 can take any of a variety of forms, such as a thermal print head, ink jet print head, electrostatic print head, or impact print head. The platen 140, by itself or with one or more of the guide rollers 136 (i.e., "bail rollers"), provides a flat printing surface on a card blank 104 positioned under the print head 138. While illustrated as a platen roller 140, the card printing device 24B can alternatively employ a stationary platen where suitable for the particular card stock and print head 138. In an alternative embodiment, the platen roller 140 may be driven by the motor 122, or by a separate motor.

The control mechanism 116 includes a microprocessor 142, volatile memory such as a Random Access Memory ("RAM") 144, and a persistent memory such as a Read Only Memory ("ROM") 146. The microprocessor 142 executes instructions stored in RAM 144, ROM 146 and/or the microprocessor's 142 own onboard registers (not shown) for generating a random playing card sequence, and printing the appropriate markings on the playing cards in the order of the random playing card sequence. The control mechanism 116 also includes a motor controller 148 for controlling the stepper motor 112 in response to motor control signals from the microprocessor 142, and a print controller 150 for controlling the print head 138 in response to print control signals from the microprocessor 142, thus synchronizing the operation of the stepper motor 112 and print head 138.

The control mechanism 116 may further include a card level detector 152 for detecting a level or number of playing cards in the playing card holder 106. The card level detector 152 can include a light source and receiver pair and a reflector spaced across the playing card holder from the light source and receiver pair. Thus, when the level of playing cards 108 in the card holder 106 drops below the path of the light, the card level detector 152 detects light reflected by the reflector, and provides a signal to the microprocessor 142 indicating that additional playing cards 108 should be printed. The card printing device 24B can employ other level detectors, such as mechanical detectors.

In operation the microprocessor 142 executes instructions stored in the RAM 144, ROM 146 and/or microprocessor's registers to computationally generate a random playing card sequence from a set of playing card values. As used herein and in the claims, the term "playing card values" refers to computational values identifying individual playing cards. For example, each playing card in one or more decks of playing cards may be uniquely defined by a serial number, which may be represented in decimal form for ease of recognition by humans, but typically takes a binary form for use by the various computational devices of the automated wager monitoring system 10. While each playing card has a rank and thus a point value, this point value is typically not the playing card value as used herein, although a point value is directly or indirectly associated with each playing card value. Also, as used herein the term "deck" or "playing card deck" refers to any collection of playing cards from which a game will be dealt, including but not limited to conventional decks of 52 cards of four suits and ranks 2–10, Jack, Queen, King and Ace.

Random number generation on computers is well known in the computing arts. Mathematicians do not generally consider computer generated random numbers to be truly random, and thus commonly refer to such numbers as being pseudo-random. However such numbers are sufficiently random for most practical purposes, such as randomly distributing playing cards to players. Hence, while we denominate the computer generated values as being "pseudo-random," such term as used herein and in the claims should include any values having a suitable random distribution, whether truly mathematically random or not.

The microprocessor 142 generates print data based on the computationally generated random playing card sequence. The print data consists of instructions for printing markings on respective ones of the playing card blanks 104 that correspond to respective playing card values from the random playing card sequence. For example, the print data can identify which elements of the print head 138 to activate at each step of the stepper motor 122 to print a desired image. During each pause between steps of the motor 122, a small portion of the card blank 104 is aligned with the print head 138 and selected elements of the print head 138 are activated to produce a portion of an image on the portion of the card blank 104 aligned with the print head 138. The image portion is a small portion of an entire image to be printed. The entire image typically is produced by stepping the card blank 104 past the print head 138, pausing the card blank 104 after each step, determining the portion of the image corresponding to the step number, determining which elements of the print head 138 to activate to produce the determined portion of the image, and activating the determined elements to produce the determined portion of the image on the card blank 104. The microprocessor 142 provides the print data as motor commands to the motor controller 148 and as print commands to the print controller 150, for respectively synchronizing and controlling the motor 122 and print head 138. The card printing device 24B can include additionally print heads to print in multiple colors, including printing that is not typically visible under conventional "white" light sources.

Thus, the card printing device 24B of FIG. 4 provides a standalone card distribution device for printing playing cards in a pseudo-random sequence, which may be used at any gaming position. Since the card printing device 24B includes a microprocessor 142, the card printing device 24B is particularly suited for the manually monitored gaming table 18 of FIG. 2, where the card interface device 24 operates in a standalone mode. However, the card printing device 24B can operate as an integral portion of the automated wager monitoring system 10, or in conjunction with such a system 10.

Figure 5:
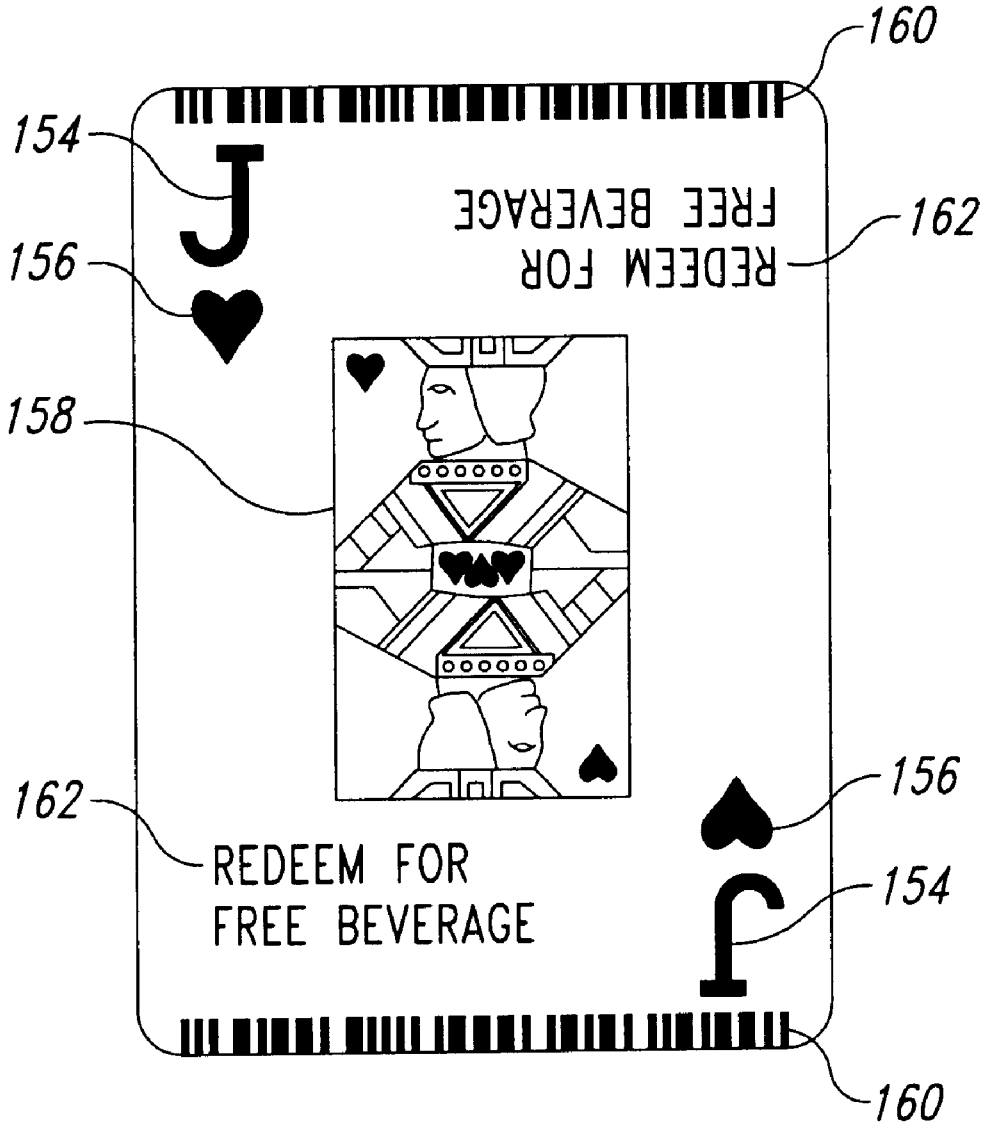
FIG. 5 is a front elevational view of a face of an exemplary playing card.

As shown in FIG. 5, the markings on the playing cards 108 (FIG. 4) may include the conventional symbols representing a rank (i.e., 2–10, Jack, Queen, King, Ace) 154 and a suit (i.e., Diamonds, Hearts, Spades and Clubs) 156 of the playing card (shown in FIG. 5). The markings can also include indicia such as the images of Jacks, Queens and Kings 158 commonly found on playing cards.

The markings may also include an identifier, for example a serial number that uniquely defines the particular playing, and/or playing card deck to which the playing card belongs. The identifier can take the form of a bar code, area code or stack code symbol 160 selected from a suitable machine-readable symbology, to allow easy machine recognition using standard readers. While visible in the illustration, the bar code symbols 160 can be printed with an ink that is only visible under a specific frequency of light, such as the UV range of the electromagnetic spectrum. This prevents players 26 from viewing the serial numbers during game play. The bar code symbol 160 can be positioned along the edges of the playing card 108 to permit reading of more than one symbol 160 at a time.

The markings can optionally include additional indicia such as advertising messages 162. The advertising messages 162 may be player or game specific, and may be provide to only specific players, to random players, and/or to all players. The advertising message 162 may take the form of promotions, for example, informing the player that the card may be redeemed for meals, beverages, accommodations, souvenirs, goods and/or services at casino facilities or other facilities. The inclusion of a serial number on the playing card, particularly a serial number encoded in machine-readable form 160 allows a promotional playing card 164 of the playing cards 108 to be easily verified using standard automatic data collection ("ADC") devices when presented for redemption.

Figure 6:
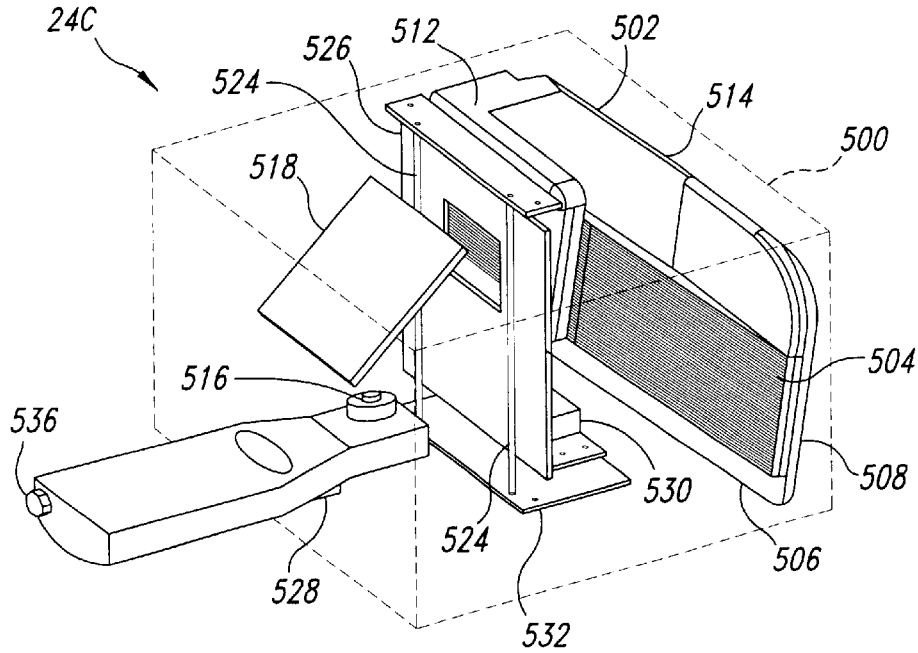
FIG. 6 is perspective view of selected components of the card reading device of FIG. 2, showing an optical lens assembly, imager, reflector, illumination assembly and connector.
Figure 7:
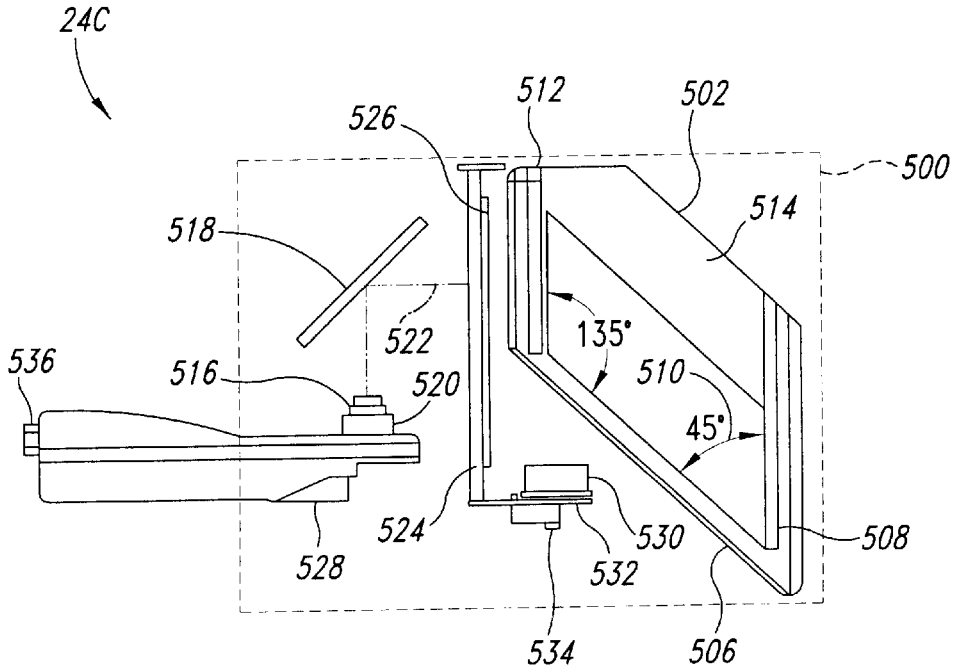
FIG. 7 is a side elevational view of the selected components of the card reading device of FIG. 6.

FIGS. 6 and 7 show the structure of the card reader 24C which can be housed separately from the card printing device 24B. The card reader 24C reads an identifier such as the machine-readable symbol 160 from the cards 61 constituting one or more completed hands collected from the players and/or dealer.

A housing 500 includes a card guide 502 that holds the cards 504 and ensures that the cards 504 are properly positioned with respect to a set of reading components, such as electronics and optical components, described below. The card guide 502 includes a card support surface 506. The card support surface 506 is sloped with respect to a base of the housing 500 to hold the cards 504 in the card guide 502 such that the cards 504 are slightly shifted or staggered with respect to adjacent cards when the discard shoe 500 is on the horizontal playing surface 26 of the gaming table 18 (FIGS. 1 and 2). A bottom end wall 508 supports the cards 504 on the sloped card support surface 506, and forms an acute angle 510 therewith. An angle 510 of approximately 45 degrees is suitable. A top end wall 512 is transparent, or has a window formed therein, to expose the ends 54 of the faces 56 of the cards 504 in the card guide 502. Side walls 514 help ensure the cards 504 are properly aligned to form a stack within the card guide 502.

The reading electronics and optics can include an optical lens assembly 516, a reflector 518, and an imager 520 aligned along an optical path illustrated by broken line arrow 522. The optical lens assembly 516 can include one or more optical lenses and filters. For example, a 9.9 FL lens assembly available from Sunex Inc., Carlsbad, Calif., part number DSL900, can serve as a suitable optical lens. Also for example, the optical lens assembly 516 can include a narrow band pass filter that passes light having a wavelength of approximately 450 nanometers, while stopping other light, such as light coming directly from an illumination source 524. A suitable filter is available from Edmond Scientific, of Barrington, N.J., as part number 00151-11859.

The imager 520 includes photo-sensitive elements, such as charged-coupled devices ("CCDs") and suitable electronics for producing a digital representation of a captured image. A CMOS color sensor, such as the CMOS color sensor available from Photobit Corporation, Pasadena, Calif., part number PB300, can serve as a suitable imager 520. The card reader 24C is particularly suited for reading up to two decks of cards, the imager 520 typically having a field of view encompassing up to two decks.

The reflector 518 can be positioned at an angle, such as a 45 degree angle, to the top end wall 512 and the imager 520 to pass an image of the ends 54 of the cards 504 to the imager 520. The card reader 24C can include additional optical components, such as reflectors, defractors, splitters, polarizers, filters and lenses, where such would be suitable to the particular application. For example, the card reader 24C can include an aperture 526 between the reflector 518 and the top end wall 512, which can improve the field of depth of the imager 520. The optical path 522 is defined by the optical properties and position of the optical components, and thus does not necessarily have to be a straight line. Many of the components can be housed in an arm 528, formed from a pair of molded plastic halves.

The card reader 24C includes an illumination system having one or more illumination sources 524 that provide low intensity illumination for the cards 504. The illumination sources 524 can take the form of one or more lamps. The illumination sources 524 produce light suitable to the particular embodiment. For example, the card reader 24C can employ illumination sources 524 that produce predominately UV light where the machine-readable symbols are only visible under UV illumination. Suitable lamps can include ultraviolet ("UV") lamps available from JKL Components Corporation of Pacoima, Calif., as part number BF350-UV1, having a diameter of 3 millimeters and a length of 50 millimeters. The illumination sources 524 are located proximate the top end wall 512 of the card guide 502. The illumination sources 524 receive power from a high voltage power inverter 530 via a printed circuit board 532 that receives power from a 5V power source 534. A suitable high voltage power inverter is available from JKL Components Corporation as part number BXA 501A.

The card reader 24C is coupled to the card printing device 24B, such as a FIREWIRE connector or Universal Serial Bus ("USB") connector. Additionally or alternatively, the card reader 24C is coupled to the network 18 or host computer 12 by way of the connector 536. Suitable connectors 536 may include a FIREWIRE connector available from Molex Electronics, Ltd. of Canada, part number 524502-05041. The connector 536 can deliver the digital representation of the captured image to the microprocessor 142 or appropriate client computing system 12 for image processing and card validation.

Figure 8:
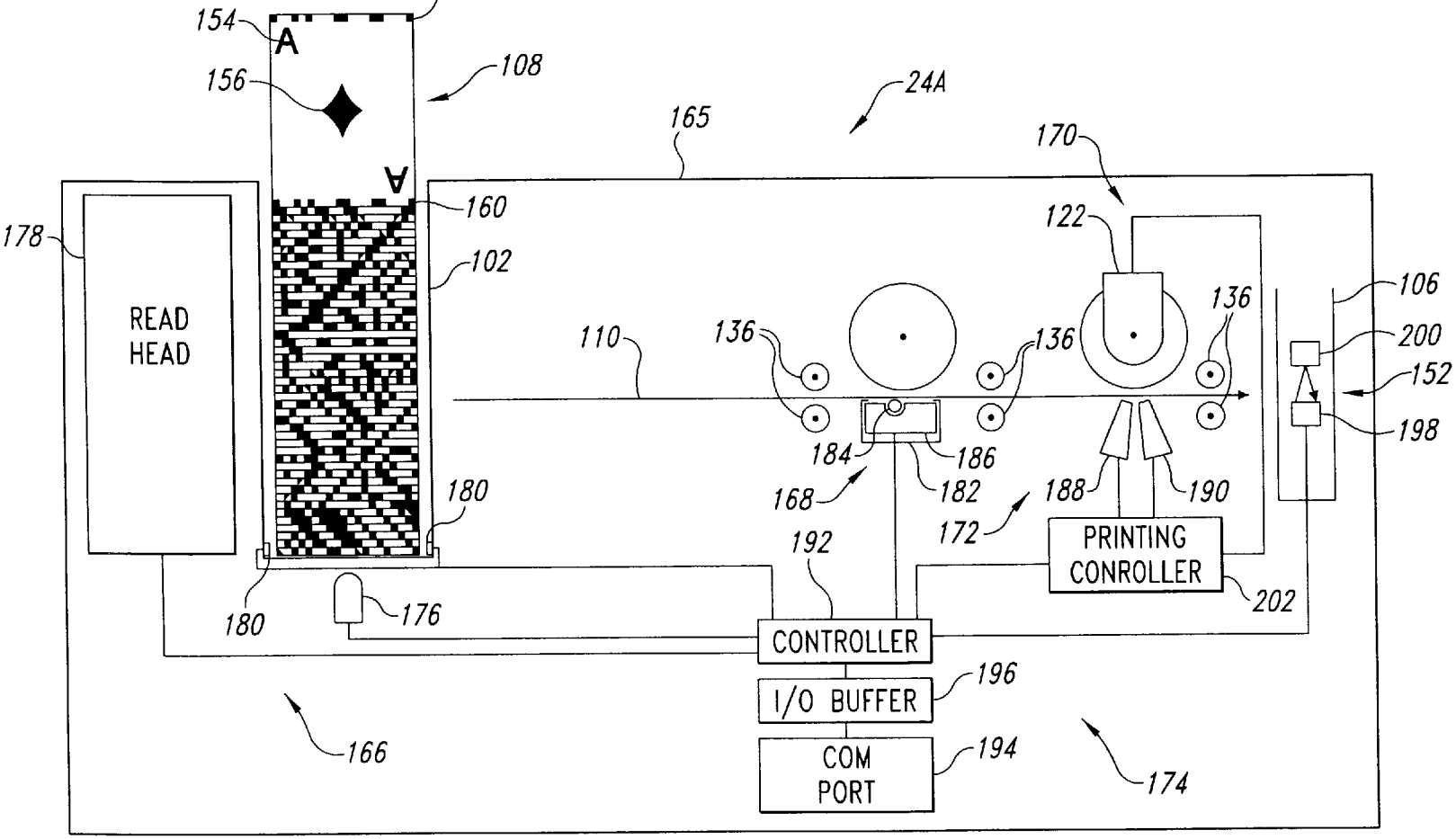
FIG. 8 is a partial side elevational view of the card interface device of FIG. 1 in the form of a combined card printing and reading device.

FIG. 8 shows another embodiment of the card interface device 24, in the form of the a card printing and reading device 24A combined in a single housing 165. The combined card printing and reading device 24A generally includes a read mechanism 166, an erase mechanism 168, a drive mechanism 170, a print mechanism 172, and a control mechanism 174.

A set of playing cards 108 located in the card receiver 102 includes identifying markings previously printed on playing card blanks. The identifying markings include a markings 154 corresponding to a rank, markings 156 corresponding to a suit, and markings 160 in the form of machine-readable bar code symbols 160 encoding a unique serial number identifying the particular card and/or deck of playing cards. While visible in the illustration, the bar code symbols 160 may be printed with an ink that is only visible under a specific frequency of light, such as the UV range of the electromagnetic spectrum to prevent identification by the player 26.

The read mechanism 166 includes a light source 176 and a reader head 178 for imaging the identifying markings 154, 156, 160 on the playing cards. The read mechanism 166 may also include optical components such as mirrors, reflectors, lenses, filters and the like.

The light source 176 may be selectively operated in response to a read command received from the host computing system 12, and/or in response to the presence of playing cards 108 in the card receiver 102. The read mechanism 166 may include a card presence detector 180 that determines when there is one or more playing cards 108 in the card receiver 102. The card presence detector 180 may take the form of a light source directing light to a reflector across the card receiver 102, and a light detector to receive the reflected light. The presence of playing cards 108 in the card receiver 102 interrupts the light, which can trigger the light source 176 directly, and/or send an appropriate signal to the host computing system 12 which may transmit a return signal to trigger the light source 176. Likewise, the reader head 178 may also be triggered directly by the card presence detector 180, or indirectly via the host computing system 12. Alternatively, in certain embodiments, the reader head 178 may remain in an ON or active state, relying on the activation of the light source 176 to capture images of the playing cards 108 in the card receiver 102.

In one embodiment, the reader head 178 includes an area imager capable of imaging a two-dimensional area encompassing the machine-readable symbols 160 on each of the playing cards in a single image. For example the reader head 178 may include a two-dimensional array of charge coupled devices ("CCDs").

In another embodiment the reader head 178 can take the form of a linear imager having a field-of-view that can be swept across the machine-readable symbols 160 on each of the playing cards 108 in succession. The read mechanism 166 may employ any of a variety of methods and structures for sweeping the field-of-view of the reader head 178. For example, the reader head 178 can be pivotally mounted for movement with respect to the playing cards 108. Alternatively, a mirror or other optical component (not shown) can be pivotally mounted for movement with respect to the reader head 178 and the playing cards 108. Alternatively, the light source 176 can be pivotally mounted for movement with respect to the playing cards 108. Alternatively, a mirror or other optical component (not shown) can be pivotally mounted for movement with respect to the light source 176 and the playing cards 108.

In yet another embodiment, the reader head 178 and field-of-view of the reader head 178 may remained fixed while the playing cards 108 are transported past the field-of-view of the reader head 178.

In a further embodiment, the reader head 178 can take the form of a scanner, such as a laser scanner, for acquiring the machine-readable symbols 160. In such an embodiment the reader head 178 would include a laser light source, photodetector, amplifier and wave shaper. Laser scanners typically do not employ additional light sources, such as the light source 176.

The construction and operation of imagers and scanners for reading machine-readable symbols is generally known in the field of automatic data collection ("ADC"), so will not be described in further detail in the interest of brevity. The structure and operation of machine-readable symbol readers is generally discussed in *The Bar Code Book*, Palmer, Roger, C., Helmers Publishing, Inc., Peterborough, N.H. (Third Edition).

An erase mechanism 168 includes an erase head 182 positionable to erase selected markings on a playing card 108. In a simple embodiment, the erase head 182 includes a rotatably mounted eraser 184 and a motor 186 coupled to rotate the eraser 184 while the eraser is in contact with the playing card 108. The eraser 184 may have a cylindrical shape, with a longitudinal axis perpendicular to the card path 110.

The drive mechanism 170 includes a motor 122 coupled to directly drive a platen roller for advancing playing cards 108 along the playing card path 110. The drive mechanism 170 may also include guide rollers 136 for orienting and guiding the playing cards 108 along the playing card path 110.

The print mechanism 172 includes a first print head 188 and a second print head 190. The first print head 188 can print visible markings on the playing card, while the second print head 190 prints invisible markings (e.g., marking only visible under UV light) on the playing card. Two print heads 188, 190 may be particularly suitable where the print heads 188, 190 are ink jet print heads, requiring separate reservoirs of ink for printing visible and invisible markings. The print mechanism 172 may include additional or fewer print heads depending on the particular printing requirements. For example, the print mechanism 172 may employ separate print heads for red and black ink, or may employ additional print heads for other colors that make up the graphics on the playing cards. Alternatively, the print mechanism 172 may employ a single print head capable of handling multiple colors (e.g., color thermal printing, dye sublimation printing). The print heads 188, 190 receive print control signals from the control mechanism 174, such as signals identifying which print elements (not shown) of the print heads 188, 190 to activate at a particular time or position.

The control mechanism 174 includes a controller 192 that couples the various other components to a communications port 194 via an Input/Output ("I/O") buffer 196. The communications port 194 can take the form of any of a variety of communications ports, such as a FIREWIRE connector, Universal Serial Bus ("USB") connector and/or a D9 connector employing an RS232 protocol. The communications port 194 can allow communications with the host computing system 12 via the LAN 78 and/or WAN 80. The I/O buffer 196 serves as a holding area for data coming into and going out of the communications port 194. The controller 192 routes data, and can perform simple control functions. While the combined card printing and reading device 24A may employ a microprocessor such as the microprocessor 142 (FIG. 4), a controller 192 provides a less expensive alternative, particularly where the network environment permits much of the processing to be distributed to other devices, for example to the host computing system 12.

The control mechanism 174 may also include a card level detector 152 for detecting a level or number of playing cards in the playing card holder 106. The card level detector 152 can include a light source and receiver 198 and a reflector 200 spaced across the playing card holder 106 from the light source and receiver 198. Thus, when the level of playing cards drops below the path of the light, the light sources and receiver 198 detects light reflected by the reflector 200, and the card level detector 152 provides a signal to the host computing system 12 via the controller 192 indicating that additional playing cards should be printed. The combined card printing and reading device 24A can employ other card level detectors, such as mechanical detectors.

The control mechanism 174 includes a printing controller 202 coupled to control the motor 122 and the print heads 188, 190.

In the embodiment of FIG. 8, the host computing system 12 determines the playing card values and generates the pseudo-random playing card sequence. The host computing system 12 also generates the print data and provides the print data to the printing controller 202 via the controller 192 to control and synchronize the operation of the motor 122 and print heads 188, 190. The print data consists of instructions for printing markings on respective ones of the playing cards 108, after the playing cards have been erased, that correspond to respective playing card values from the random playing card sequence generated by the host computing system 12. Alternatively, the host computing system 12 can provide motor control signals and print control signals directly to the motor 122 and print heads 188, 190 via the controller 192. In a further alternative, the controller 192 can be configured to also serve as a printing controller, receiving the print data and providing the motor control signals and print control signals the motor 122 and print heads 188, 190. In yet a further alternative, the host computing system 12 can provide print data to a motor controller and print controller, such as the motor controller 148 and print controller 150 shown in FIG. 4, for controlling the motor 122 and print heads 188, 190, respectively.

Since the card printing and reading device 24A receives data such as a random playing card sequence from the host computing system 12 and/or print data, the combined card printing and reading device 24A of FIG. 8 may be a relatively low cost device, employing a simple controller 192 and/or print controller 202 rather than a relatively more expensive microprocessor. Thus, the combined card printing and reading device 24A is particularly suited for use with the networked automated wager monitoring system 10 of FIG. 1. Thus, the combined card printing and reading device 24A provides an integrated networked device for printing playing cards in a pseudo-random sequence.

The combined card printing and reading device 24A also reads the playing cards 108 in the card receiver 102, allowing the tracking of playing and wagering according to methods described in commonly assigned U.S. patent applications listed at the end of this specification. Additionally, the combined card printing and reading device 24A reuses playing cards 108, erasing previous markings after reading the playing cards 108 and before printing new markings on the playing cards 108.

Real-time, or almost real time playing card printing may realize a number of distinct advantages over mechanical shufflers. For example, the playing card printing devices 24A, 24B can employ an unlimited number of "virtual" card decks (i.e., playing card values) in creating the random playing card sequence, only printing the limited number of physical playing cards required for playing a game. For example, the playing card printing device 24A, 24B can receive or generate, respectively, the random playing card sequence from 500 decks of cards or more, yet print only one or two decks of playing cards, or as few hands of playing cards, as needed. The playing card printing device 24A, 24B may also produce a more truly random sequence than a mechanical shuffler, which is prone to incomplete shuffling due to the inherent consistencies of mechanical systems. The card printing devices 24A, 24B may also increase the speed of play since the card printing devices 24A, 24B eliminate the need for repeated mechanical manipulations of the playing cards.

Figure 9:
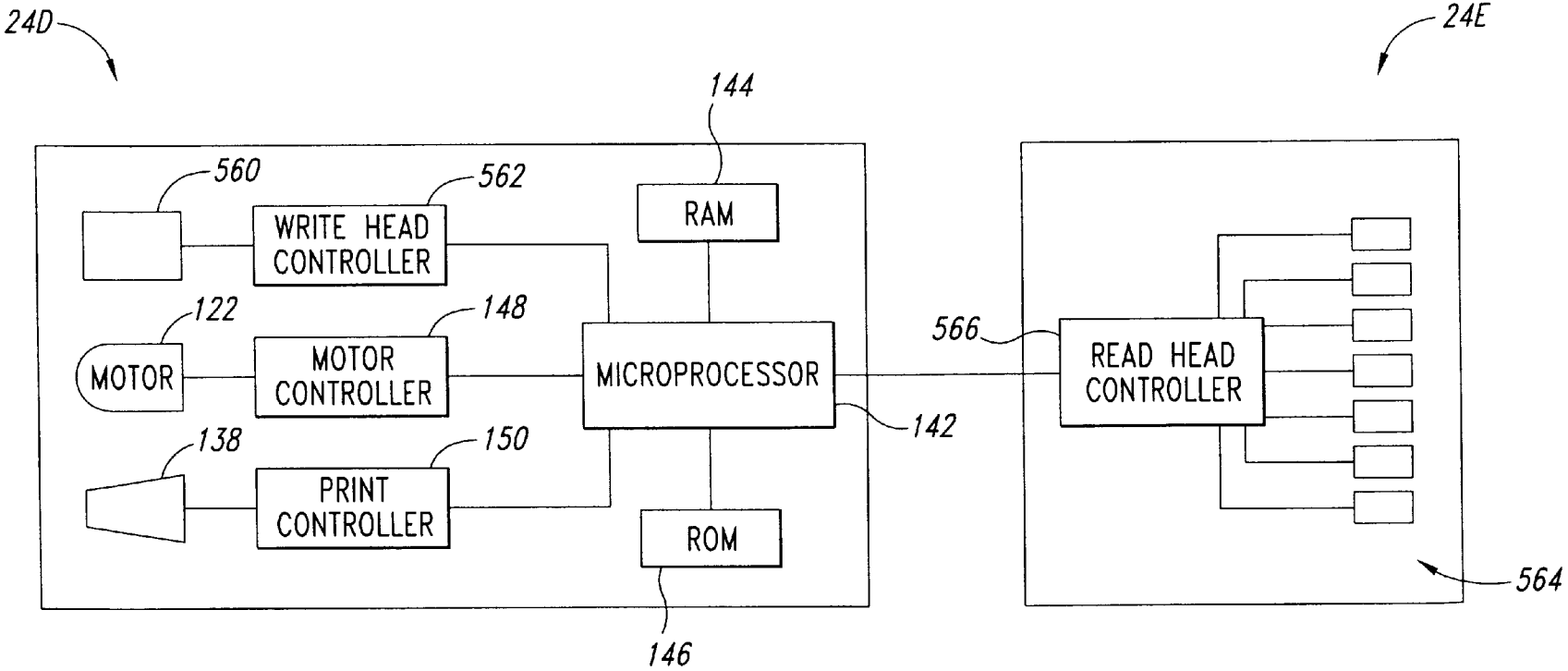
FIG. 9 is a partial side elevational view of an alternative card reading device, including a magnetic reading head for reading magnetic markings on playing cards.

FIG. 9 illustrates a further alternative embodiment for use with magnetically encoded identifying data, for example, identifying data encoded in magnetic strips carried by the cards. As above, similar acts and elements are identified with the same reference numerals, and only significant differences in structure and operation will be discussed.

A card printing and writing device 24D includes many of the same or similar components as the card printing devices 24A, 24B such a motor 122, motor controller 148, print head 138 and print head controller 150. However, the card printing and writing device 24D also includes a magnetic write head 560 and a write head controller 562 coupled to the magnetic write head 560. Magnetic write heads and controllers are commonly known in the relevant art. While not illustrated, the card printing and writing device 24E may also include a magnetic erase head positioned before the magnetic write head 560 in the card path 110 to erase data previously encoded on the playing cards.

The card reading device 24E includes one or more magnetic read heads 564 for reading the data encoded in the magnetic strips (not shown) from cards collected after play. A read head controller 566 controls the magnetic read heads 564 and provides the read information to the microprocessor 142 in the card printing and writing device 24D. Thus, the card reading device 24F can provide the microprocessor 142 with a set of card identifiers in a sequence determined by the play of the game and the order of collection of the completed hands. The microprocessor 142 can recreate or evaluate the game based on the starting and ending card sequences in a similar manner to the machine-readable symbol embodiments (FIGS. 1–8). In a further alternative, the card printing and writing device 24D can provide the reader 24E with the generated pseudo-random sequence, where the card reading device 24E contains suitable electronics for processing the information.

Operation

Figure 10A:
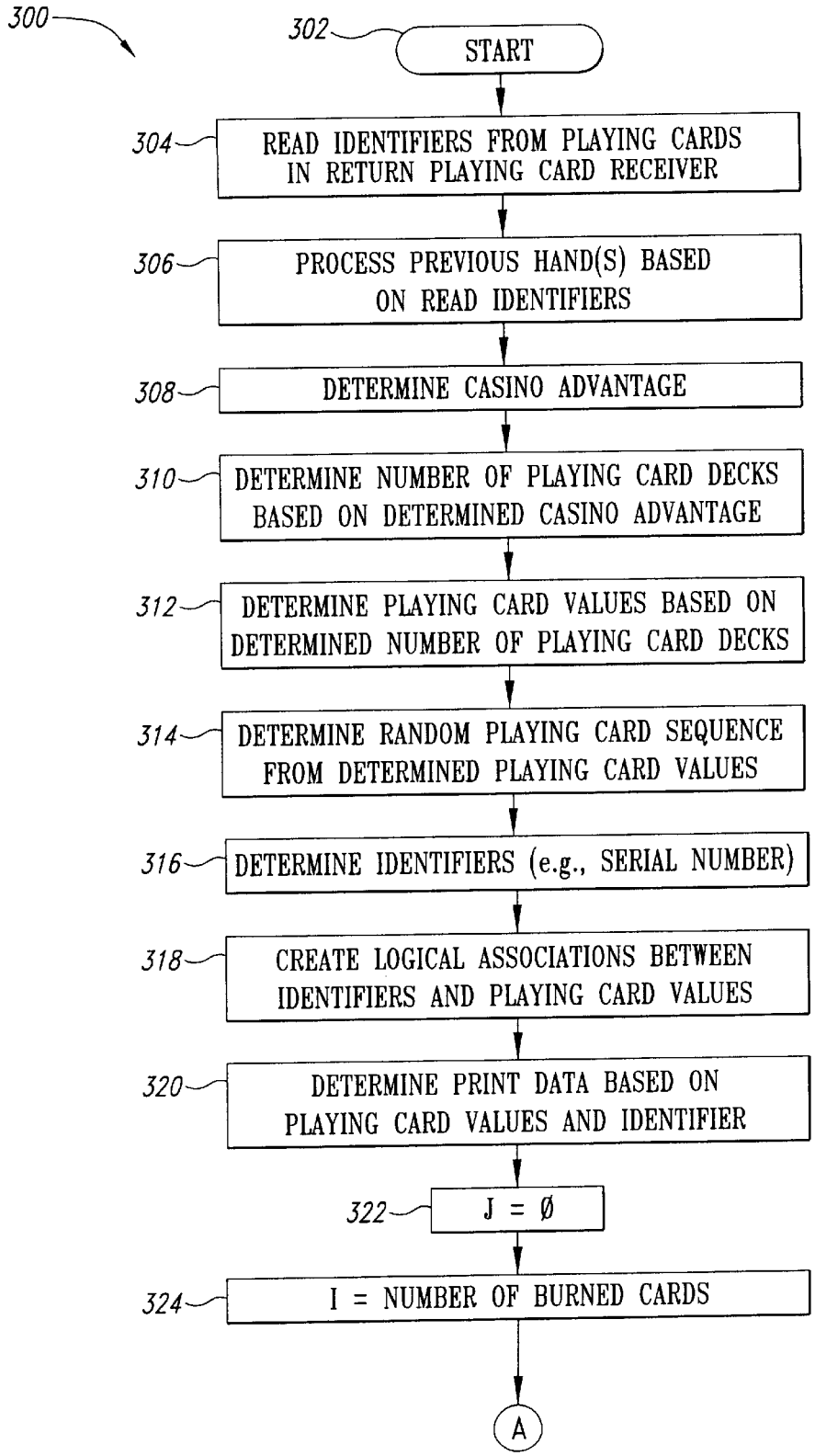
FIGS. 10A–10B are a flow diagram showing a method of operating the host computing system of FIG. 1 and the card distribution device of FIG. 6.
Figure 10B:
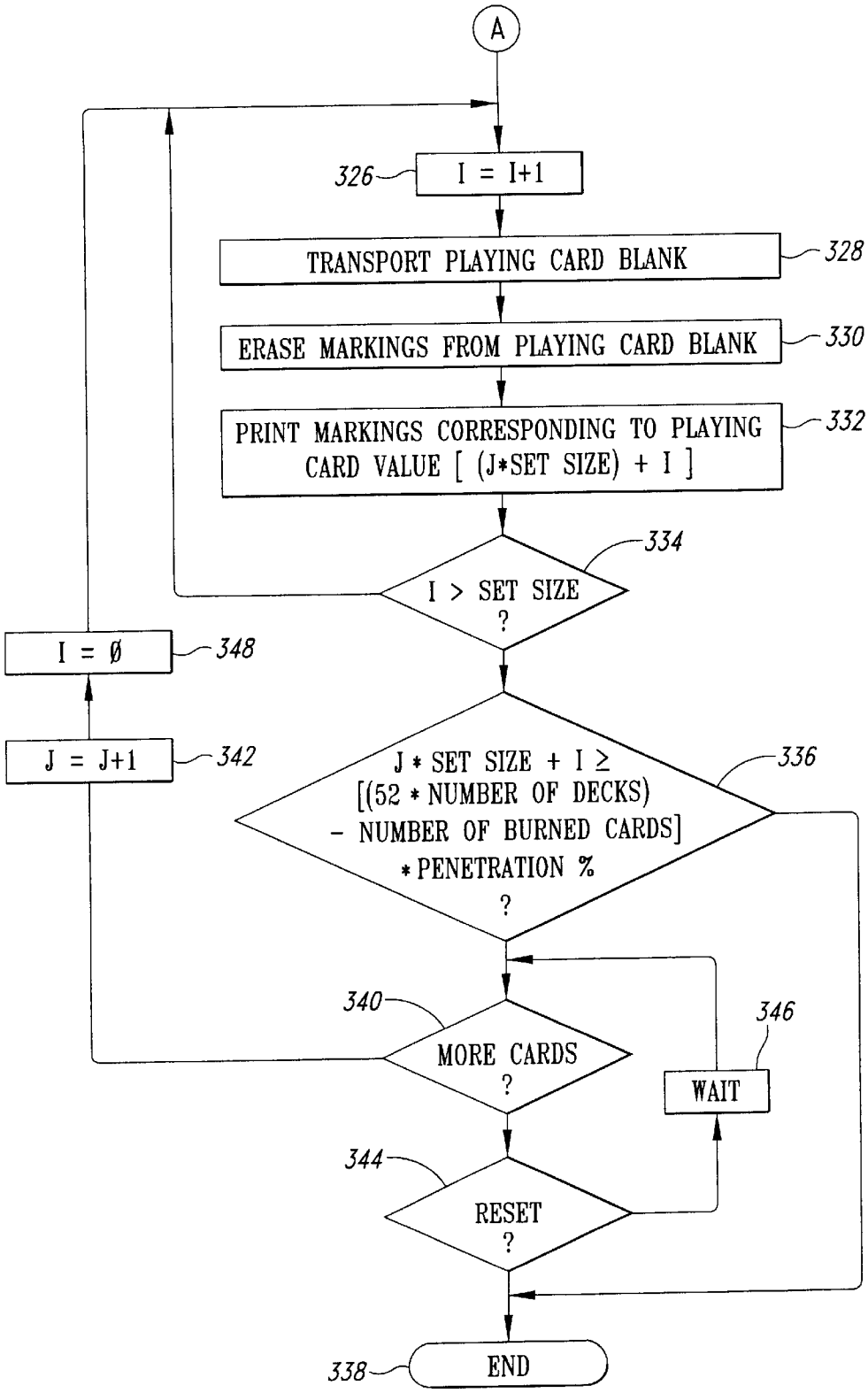

FIGS. 10A–10B show a method 300 of operation for the combined card printing and reading device 24A of FIG. 8, starting in step 302. While discussed below in terms of remote operation by the host computing system 12, an appropriately configured card printing and reading device 24A could execute some or all of those functions. Portions of the method 300 are also applicable to the non-integral embodiments having separately housed card printing and reading devices 24B, 24C, 24D of FIGS. 4 and 6, 7 and 9.

In step 304, the combined card printing and reading device 24A reads machine-readable symbols 160 from the playing cards 108 in the card receiver 102 employing the reader head 178, as generally described above. One skilled in the art will recognize the rank and suit markings 154, 156 could be read, however the machine-readable symbols are typically easier to process with existing hardware and software. In step 306, the host computing system 12 processes the previous hands based on the identifiers encoded in the read machine-readable symbols 160. The host computing system 12 can employ methods and apparatus taught in commonly assigned U.S. patent applications listed at the end of this specification. For example, where the reader head 178 (FIG. 8) includes an imager, the imager captures a digitized image of the symbol 160 on each playing card 108. The digitized image is sent to either the server computing system 14 (FIG. 1) or one of the client computing systems 12 for processing. The server computing system 14 or one of the client computing systems 12 resolves the digitized image into machine-readable symbols. The server computing system 14, or one of the client computing systems 12 then converts the machine-readable symbols into respective serial numbers and/or card ranks. Alternatively, some or all of the processing can be performed by an appropriately configured processor housed in the card interface device 24.

In step 308, the host computing system 12 determines the casino advantage for the game. Typically, the casino advantage is dependent on a number of factors, including the type of card game, the particular rules employed by the casino for the type of card game, and the number of decks or cards from which the cards are dealt. In an alternative embodiment, the casino advantage may also depend on the composition of those playing card decks where, for example, certain playing cards are removed or added to the card decks (e.g., 5 Aces in one or more card decks; and/or only 3 Kings in one or more card decks). The host computing system 12 may rely on a previously defined game type, game rules and number of decks, or may allow the dealer 30, or even the player 26, to select one or more of the parameters. For example, the dealer 30 may select the desired advantage and provide suitable house odds to the player 26 based on the advantage. Alternatively, the player 26 may select a set of desired house odds, and rely on the host computing system 12 to select the appropriate casino advantage corresponding to those house odds. Thus, the casino can offer the player 26 higher odds where the player 26 is willing to play against a hand dealt from a larger number of playing cards 108. The casino can also offer the player 26 higher odds where certain playing cards are omitted from one or more card decks. Additionally, or alternatively, the casino can offer the player higher odds or a bonus for receiving a particular hand, such as 5 sevens.

In step 310, the host computing system 12 determines the number of decks of playing cards required to deal a game having the determined casino advantage. In step 312, the host computing system 12 determines a set of playing card values based on the determined number of card decks. Typically, the host computing system 12 will employ one playing card value for every playing card rank and suit combination for each of the determined number of playing card decks (e.g., 52 playing card values per card deck). Thus, the host computing system 12 employs "virtual" playing cards, i.e., values representing playing cards in one or more "virtual" decks.

The playing card values can take any of a variety of forms which is capable of identifying each individual playing card, and which is convenient for computational use. For example, each playing card in a conventional deck can be assigned an integer value 1–52. Successive integers can be assigned where more than one card deck is used. For example, each playing card rank and suit combination in a second conventional deck can be assigned a respective integer playing card value from 53 to 104. The playing card rank and suit combinations in each "virtual" card deck may be in a matching predefined sequence. For example, the playing card value corresponding to the two of hearts combination may be 1 for the first deck and 53 for the second deck, while the playing card value for the Ace of spades may be 52 for the first deck and 104 for the second deck. Employing the same sequence for mapping the playing card values to the rank and suit combinations in multiple "virtual" card decks facilitates later card identification or recognition, while not hindering the generation of pseudo-random sequences. Employing longer and non-sequential serial numbers, and/or encryption can realize a higher degree of security.

In step 314, the host computing system 12 generates a pseudo-random playing card sequence from the determined playing card values. Methods of random number generation are well known in the computer arts so will not be described in detail. The random number generation employs a range initially including all of the determined playing card values. Thus, the host computing system 12 can generate a random sequence that is unaffected by mechanical consistencies of any device, or mechanical limitations on the total number of playing cards.

In step 316, the host computing system 12 determines identifiers for the playing cards 108, such as unique serial numbers. The identifier can uniquely identify the particular playing card, and/or the card deck to which the playing card belongs. A non-sequential assignment of identifiers may enhance security. In an alternative embodiment, discussed below, the machine-readable symbols 160 encoding the identifiers remain printed on the card blanks, thus new identifiers do not need to be determined.

In step 318, the host computing system 12 creates logical associations between the identifiers and the playing card values. For example, the host computing system 12 can store the logical association between playing card values and respective identifiers as a database stored in a computer-readable memory. The logical association maps the playing card values, and hence the rank and suit markings 154, 156 to be printed on a playing card 108, with the identifier which is to be printed on the same playing card 108 in the form of a machine-readable symbol 160.

In step 320, the host computing system 12 determines the print data based on the playing card values and identifiers. As discussed above, the print data includes the specific instructions for printing the various markings 154, 156 and/or 160 on the corresponding playing cards 108. In an alternative embodiment, the printing controller 202 can determine the print data based on the playing card values, identifier or other information supplied by the host computing system 12. For example, a computer-readable memory (not shown) in the combined card printing and reading device 24A can store print data for each of the 52 different playing card faces in a typical card deck. A portion or all of the playing card value supplied by the host computing system 12 can identify the appropriate print data to the printing controller 202 for printing the corresponding playing card 108.

Where the host computing system 12 performs steps 316, 318 and/or 320 immediately after the step of determining the random playing card sequence 314, the host computing system 12 may determine the identifiers, create the logical associations and determine the print data for all of the playing card values in the random card sequence. Alternatively, the steps 316, 318 and/or 320 can be performed for smaller sets of playing cards, or even on a card-by-card basis, for example immediately before each playing card is printed. Thus, identifiers will not be assigned for cards which may never be used in play with the consequent benefit of conserving unique identifiers. This approach may also reduce the load on the host computing system 12, with consequent benefits in reduced infrastructure and/or increased operating speed.

The host computing system 12 and/or printing controller 202 initializes various counters in preparation for printing the physical playing cards 108 according to the computationally generated pseudo-random playing card sequence of playing card values. For example, in step 322 the host computing system 12 and/or printing controller 202 sets a first counter J equal to 0 (ie., J=0). In step 324, the host computing system 12 and/or printing controller 202 sets a second counter I equal to a number of cards to be burned (e.g., I=3). Casinos typically skip an initial number of playing cards when dealing from a freshly shuffled card deck in a procedure commonly reference to as "burning the cards." This hinders a player's ability to accurately count cards. Setting the first counter J equal to the number of cards to be burned, prevents the card printing and reading device 24A from printing these playing cards, possibly saving playing card blanks, ink and/or time. Alternatively, the number of playing cards to be burned can be set equal to 0, and the dealer 30 may physically discard an appropriate number of playing cards 108 prior to dealing. Casinos may find this method preferable as a visible deterrent to card counting, and/or to make the card game appear as similar as possible to conventionally dealt cards games.

In step 326, the host computing system 12 and/or printing controller 202 increments the second counter I (i.e., I=I+1) in preparation for printing the next playing card. In step 328, the drive mechanism 170 of the combined card printing and reading device 24A transports a playing card 108 along the card path 110, employing the motor 122 as discussed generally above. In step 330, the erase mechanism 168 of the combined card printing and reading device 24A erases the markings 154, 156, from the face of the playing card employing the erasure head 182 as generally described above. In some embodiments, the machine-readable symbol 160 may be erased in preparation to providing a new machine-readable symbol 160 encoding a new identifier such as a unique serial number. This procedure may provide enhanced security, making it more difficult to obtain the identifiers. In other embodiments, the machine-readable symbol 160 can be left in tact, and a new logical association made between the identifier or serial number encoded in the machine-readable symbol 160 and the new playing card value and/or the rank and suit markings 154, 156 assigned to the particular playing card 108.

In step 332, the print mechanism 172 of the card printing and reading device 24A prints new markings 154, 156, and/or 160 on the playing card 108 employing the printing heads 188, 190.

In step 334, the host computing system 12 and/or printing controller 202 determines whether the second counter I is greater than a set size value. The set size value can be set to any convenient size. For example, the set size can be set to 52 playing cards where playing cards will be dealt from a handheld deck by the dealer 30. If the second counter is not greater than the set size, control returns to step 350, where the second counter I is incremented in preparation for the next playing card. If the second counter is greater than the set size, control passes to step 348.

In step 336, the host computing system 12 and/or printing controller 202 determines whether there are sufficient playing card values remaining in the playing card sequence to print the next set of playing cards. Thus, the host computing system 12 and/or printing controller 202 assesses deck penetration (i.e., how many cards remain to be dealt). One way of assessing deck penetration is to determine whether the current card count is equal to or greater than the total number of cards multiplied by a deck penetration percentage. A suitable mathematical formula for such is given as: J*Set Size+I≧((52*Number of Decks)−Number of Burned Cards)*Percentage. Alternatively, the penetration can be represented as a number of cards that are not to be dealt. Thus, the mathematical representation would be given as: J*Set Size+I≧((52*Number of Decks)−Number of Burned Cards)−Number of Cards To Not Be Dealt.

If the host computing system 12 and/or printing controller 202 determine that the deck has been sufficiently penetrated, control passes to step 338 where the method terminates, although the method 300 may execute in a continuous loop, or in a multi-threaded fashion as suits the particular environment. The method 300 can then be restarted to produce a new set of playing cards in a pseudo-random sequence. If the host computing system 12 and/or printing controller 202 determine that the card deck 108 has not been sufficiently penetrated, control passes to step 340. In step 340, the host computing system 12 and/or printing controller 202 determine whether additional playing cards 108 should be printed. For example, the host computing system 12 and/or printing controller 202 can check the status of the card level detector 152 to determine whether a sufficient number of playing cards remain in the card holder 106.

If there are not sufficient playing cards control passes to step 342. If there are sufficient playing cards remaining, the controller 192 and/or host computing system 12 determines whether a reset has been requested, in step 344. A reset may be automatically requested, for example in response to an occurrence of an error condition, or may be manually requested. A manual request may occur, for example, by the dealer 30 selecting a reset or new shuffle switch when the dealer wishes to deal from a new set of cards. The dealer 30 or other casino personnel may select this option when, for example, the dealer 30 suspects the player 26 of card counting. If a reset condition has occurred, control is passed to step 338, where the method ends. If a reset condition has not occurred, the host computing system 12 and/or printing controller 202 execute a wait loop 346, returning control back to step 340.

In step 342, the host computing system 12 and/or printing controller 202 increments the first counter J, and in step 348 initializes the second counter I (i.e., I=0), in preparation for printing the next set of playing cards. The host computing system 12 and/or printing controller 202 passes control back to step 326 to print the next playing card 108.

While the embodiment of FIGS. 10A–10B employs the host computing system 12 for the primary portion of the processing, the processing may be distributed to other computing systems and/or processors distributed throughout a casino, or associated with one or more of the gaming tables 18. Distributing the processing may reduce the workload on the host computing system, allowing a smaller processor to handle more wagering, and perhaps providing faster results. However, retaining processing at the host computing system 12 may provide better control over the software, and may make changes to the software simpler. The above described system may also employ a mix of the above approaches, for example, retaining processing at the host computing system 12 for some aspects such as random number generation, while distributing the processing to card printing device 24A, 24B for other aspects such as generating print data and/or printing.

Figure 11:
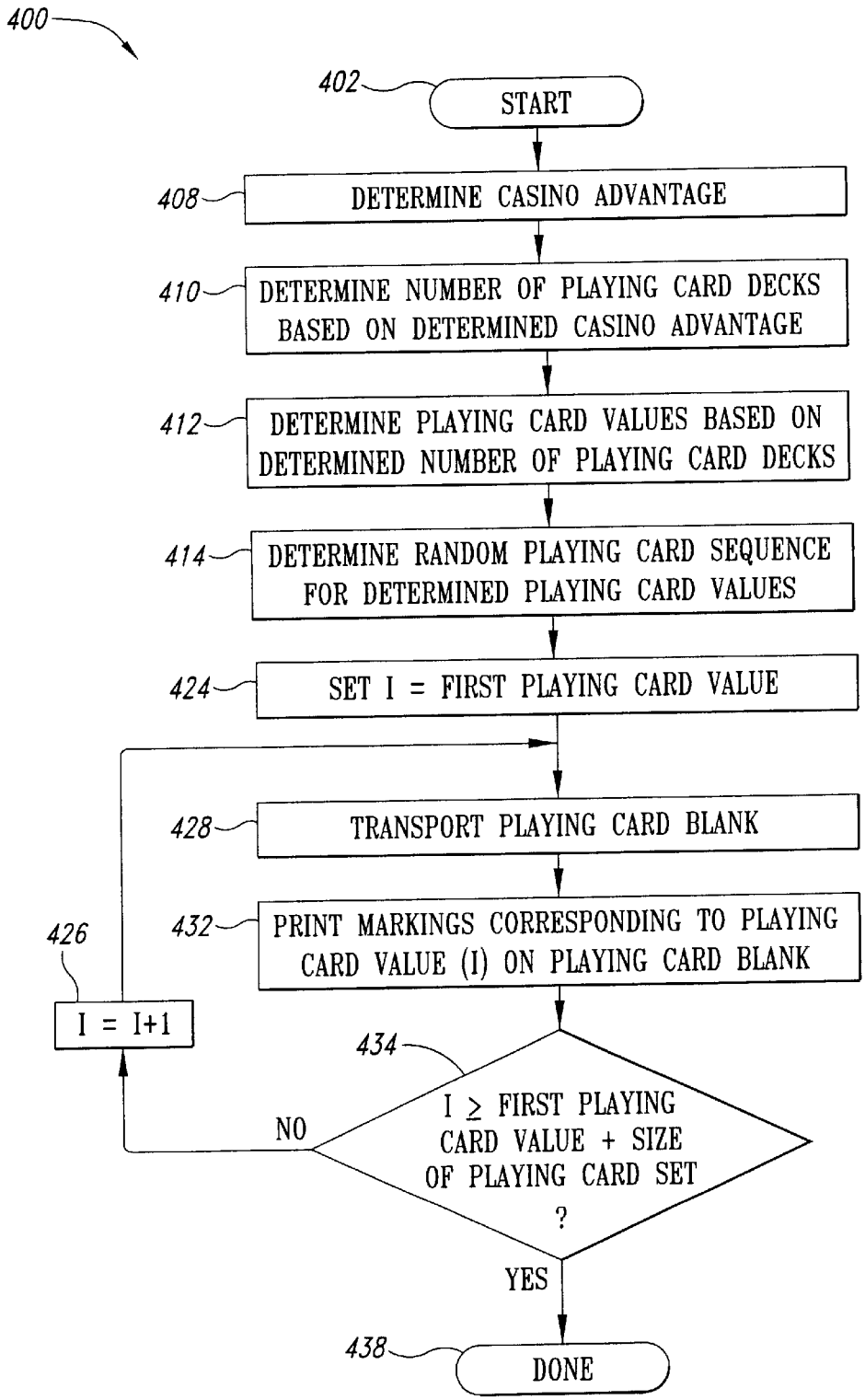
FIG. 11 is a flow diagram showing a method of operating the card distribution device of FIG. 4.

FIG. 11 illustrates a method 400 of operation for the playing card printing device 24B of FIG. 4, starting in step 402. While discussed below in terms of remote operation by the microprocessor 142, an appropriately configured card printing device 24B could distribute some or all of those functions to an external computing system or processor. Portions of the method 400 are similar to the method 300 of FIGS. 10A–10B, thus common acts and structures will be identified using similar reference numbers, differing only in the most significant digit (e.g., 312 is similar to 412), and only significant difference in operation will be discussed below.

The method 400 starts in step 402. In step 408, the microprocessor 142 determines the casino advantage for the game. Determining the casino advantage is been discussed in detail above.

In step 410, the microprocessor 142 determines the number of decks of playing cards required to deal a game having the determined casino advantage. In step 412, the microprocessor 142 determines a set of playing card values based on the determined number of card decks. In step 414, the microprocessor 142 generates a pseudo-random playing card sequence from the determined playing card values. In step 416, the microprocessor 142 determines identifiers for the playing cards 108, such as unique serial numbers. In optional step 418, the microprocessor 142 creates logical associations between the identifiers and the playing card values. In step 420, the microprocessor 142 determines the print data based on the playing card values and identifiers. The steps 416, 418 and/or 420 may be performed for smaller sets of playing cards, or even on a card-by-card basis, for example immediately before each playing card is printed. In step 424, the microprocessor 142 sets a first counter I equal to a first playing card value, including any of a number of cards to be burned (e.g., I=3). In step 428, the drive mechanism 112 (FIG. 4) of the card printing device 24B transports a playing card 108 along the card path 110. In step 432, the print mechanism 114 (FIG. 4) of the card printing device 24B prints new markings 154, 156, and/or 160 on the playing card 108 employing the printing head 138.

In step 434, the microprocessor 142 determines whether there are additional playing card values in the random sequence of playing cards. For example, the microprocessor 142 can determine whether the first counter I is equal to or greater than the total number of playing card values minus any burned cards and/or reserved cards (e.g., card penetration). If the there are additional playing cards, control passes to step 426, where the first counter I is incremented (I=I+1) in preparation for printing the next playing card. If there are no additional playing card values, the method 400 terminates in step 438, or alternatively returns to the start 402 to continuously execute.

Game Verification Operation

Figure 12:
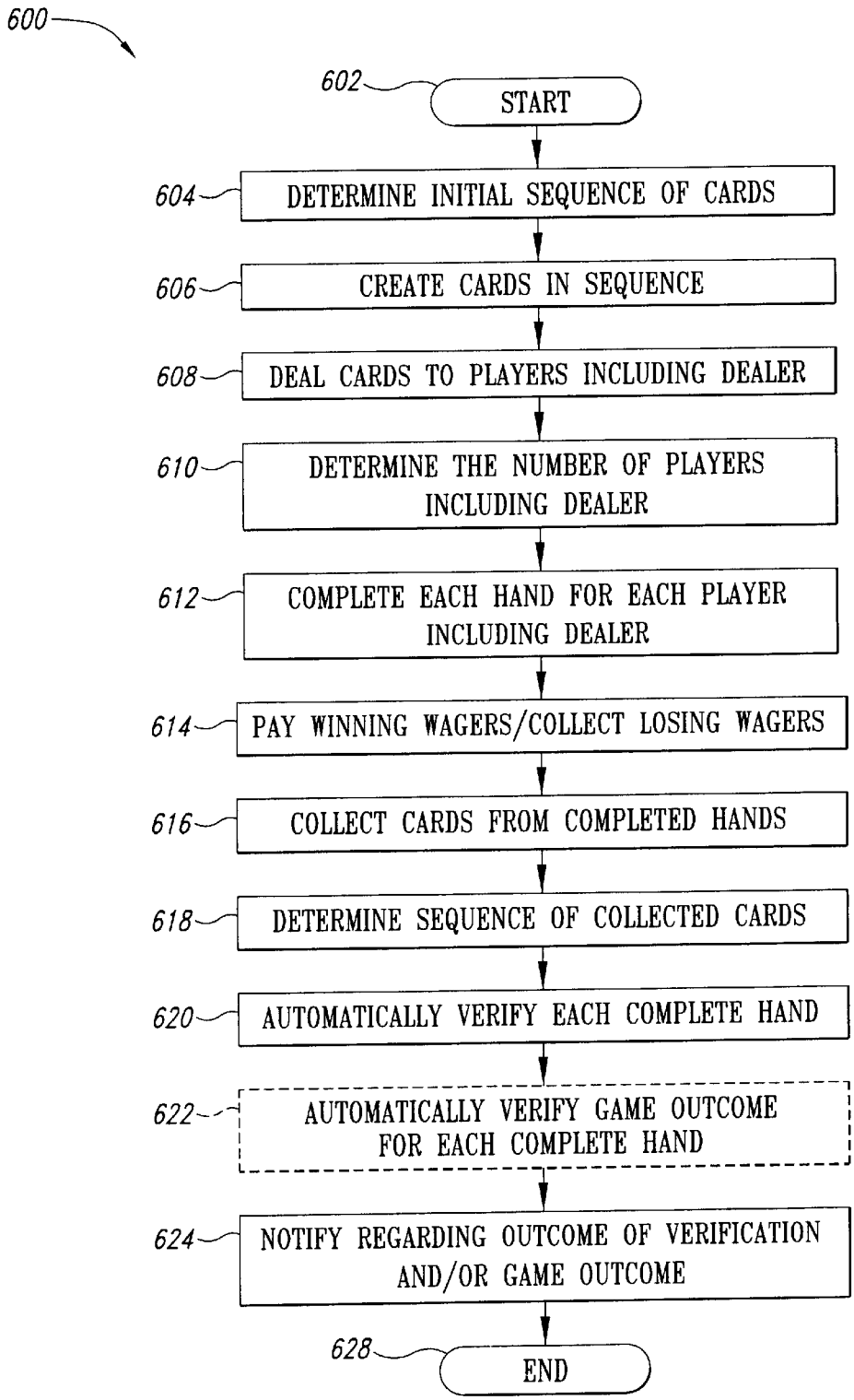
FIG. 12 is a flow diagram of a method of operating the card game evaluation system 9.

FIG. 12 shows an overview of an illustrated method 600 of operating the card game evaluation system 10. Additional flow diagram (FIG. 13) and card sequences (FIGS. 14–16) illustrate more detailed aspects of the operation of the card game evaluation system 10, as well as actions of the dealer employing the game evaluation system 10.

The operating method 600 starts at step 602, for example in response to the insertion of a card blanks into the card printing device 24A, 24B. In step 604, the card game evaluation system 10 determines the initial sequence of card values. In step 606, the card printing device 24A, 24B or card printing and writing device 24D creates playing cards matching the determined initial sequence of card values.

In step 608, the dealer deals the cards in the conventional fashion to the players and to the dealer's self. For example, in twenty-one the dealer deals a first initial card to each of the players from the dealer's left (i.e., first base) to the dealer's right (i.e., third base), then to the dealer's self (i.e., top card), followed by a second initial card to each of the players from the dealer's left to right, then to the dealer's self (i.e., hole card).

In step 610, the card game evaluation system 10 determines the number of players including the dealer, playing the particular game. In one embodiment, the dealer places the dealer's initial hand (i.e., top card and hole card) into a card hand reader (not shown) for reading. The card hand reader 25 reads the dealer's initial hand as explained in commonly assigned U.S. patent applications listed below. As explained above, the card game evaluation system 10 can rely on a machine-readable symbol such as a bar code or magnetic strip encoding a serial number of the suit and rank of the card read by the card hand reader 15. The card game evaluation system 10 determines the number of players from the number of cards in the initial sequence of card values between the cards forming the dealers initial (i.e., top and hole cards). Since a first card is dealt to each player before a second card is dealt, the number of cards between the dealer's top and hole cards is equal to the number of players in the game including the dealer.

In an alternative embodiment, the card game evaluation system 10 can determine the number of players positions at the gaming table, for example by detecting the location of cards and/or chips, as described in commonly assigned U.S. patent application listed at the end of this specification.

In step 612, the dealer completes each hand for each of the players from the dealer's left to right, then completes the dealer's own hand. For example, in the game twenty-one, the dealer determines whether the player's hand is complete. The player's hand will only be complete if the player has a total value of twenty or a blackjack (i.e., initial hand with value of twenty-one). If the player's hand is complete (i.e., blackjack), the dealer may immediately pay the player in step 614, or may wait to perform the step 614 until all hands have been played. The dealer then collects the player's hand to be placed into the discard shoe. If the player's hand is not complete, the dealer offers the player an additional card and determines whether the player stands. If the player does not stand the dealer deals another card to the player, repeating the process for the player until the player busts or stands. The dealer completes the hands of all other players in a similar fashion.

The dealer then determines whether the dealer's own hand is complete (i.e., twenty-one or blackjack). If the dealer's hand is complete, the dealer pays winning wagers and collects losing wagers in step 614. If the dealer's hand is not complete, the dealer determines whether to stand or not. The house rules typically determine whether the dealer stands or takes another card. For example, the rule may require the dealer to stand if the value of the dealer's is 17 or more. Under some rules, the dealer may take another card if the value of the dealer's hand is a soft 17 (i.e., Ace counted as eleven). If the dealer does not stand, the dealer takes an additional card, repeating the process until the dealer either busts or stands.

After paying winning wagers and collecting the losing wagers in step 614, the dealer in step 616 collects any remaining hands of cards in the conventional manner and places the collected in the discard shoe. In step 618, the determines the sequence of the collected playing cards. For example, the read head 178 or card reading device 24C, 24E reads identifiers from each of the collected cards.

In step 620, the card game evaluation system 10 automatically verifies each complete hand of playing cards, ensuring that the cards dealt to each player including the dealer match the cards that should have been dealt to the players based on the initial sequence of playing card values, the position of the player relative to the other players, and the number of hit cards taken by each of the players.

In optional step 622, the card game evaluation system 10 automatically verifies the game outcome for each complete hand, ensuring that the outcome determined by the dealer matches the outcome that should have occurred based on the initial sequence of playing card values, the position of the player relative to the other players, and the number of hit cards taken by each of the players.

In step 624, the card game evaluation system 10 notifies the dealer, the casino and/or other authorized personnel regarding the outcome of the hand verification and or game outcome verification. The method 600 concludes in step 628.

Figure 13:
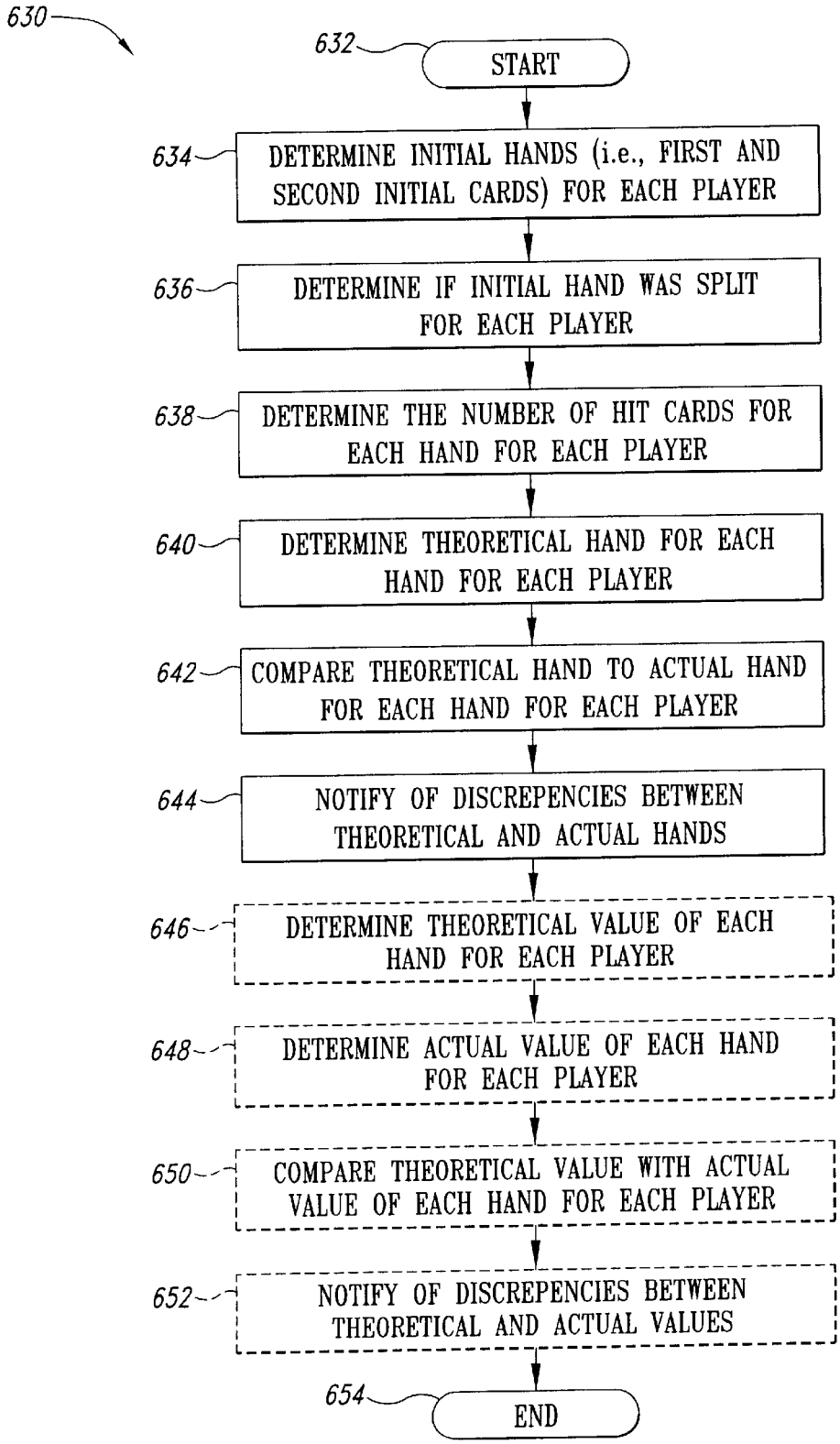
FIG. 13 is a flow diagram of a method of verifying completed hands of playing cards.

FIG. 13 shows an exemplary method 630 of operating the card game evaluation system 10 in the gaming environment of blackjack. In particular, method 630 identifies specific acts by the card game evaluation system 10 in verifying each complete hand, starting in step 632. The method 630 is described with reference to an example game of twenty-one, illustrated in FIGS. 14–16. The example is for illustrative purposes, and other sequences of card values, collected playing cards, game rules and game play are of course possible.

In step 634, the card game evaluation system 10 determines the theoretical initial hands (i.e., first and second initial cards) for each player. Since cards are dealt to players from the dealer's left to right, then to the dealer, the card game evaluation system 10 can determine the theoretical initial hands from the initial sequence of playing card values 93, represented in FIG. 14. The initial sequence of playing cards 93 is known since the card game evaluation system 10 generated the initial sequence 93.

Each player i from the dealer's left to right, and the dealer should receive the $i^{th}$ card and the $n+i^{th}$ card, where the two of hearts is the first card and n is the total number of players including the dealer. Thus, the theoretical initial hand of the player on the dealer's left (i.e., first base) is composed of the first card value and the $n+1^{st}$ card value from the initial sequence of card values 93. The theoretical initial hand of the next player to the right is composed of the $2^{nd}$ and the $n+2^{nd}$ card values from the initial sequence of card values. The dealer's theoretical initial hand is composed of the nth and the $n^{th}+n^{th}$ card values from the initial sequence of card values.

The initial hands of the players and dealer in this example are shown in table 1, below.

TABLE 1

| Inital cards | |
|---|---|
| | Initial Cards |
| Player 1 | 2 8 ♥,♣ |
| Player 2 | 9 10 ♠,♠ |
| Player 3 | 7 7 ♣,♠ |
| Dealer | A 8 ♠, ♥ |

In the game twenty-one, players may split their initial hand into two separate hands in certain situations (e.g., two of a kind), each card in the initial hand forming a portion of one of the resulting hands. Thus, in step 636 the card game evaluation system 10 determines for each player whether the initial hand was split. The card game evaluation system 10 can determine split hands by inspecting the sequence of collected cards 94, illustrated in FIG. 15, based on a knowledge of the player's theoretical initial bands. Where a player's initial cards are not immediately adjacent one another in the sequence of collected cards 94, the player has split their initial hand.

Figure 15:
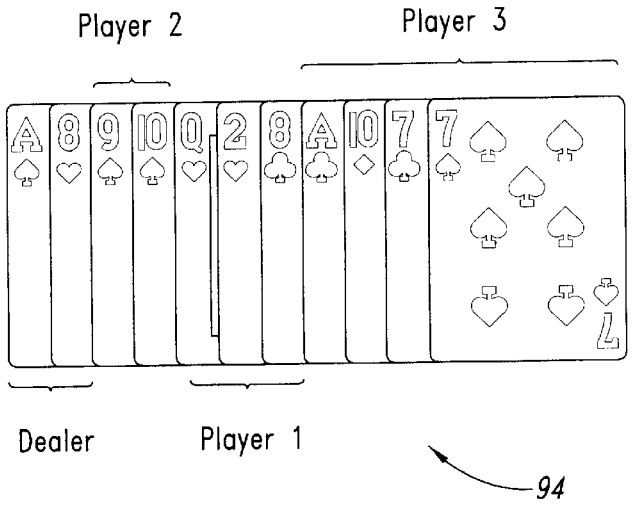
FIG. 15 is a schematic view of playing cards collected after an example round of twenty-one with four players including the dealer.

In step 638, the card game evaluation system 10 determines the number of hit cards for each hand of each player. Again, the card game evaluation system 10 relies on the sequence of collected cards 94 (FIG. 15) and a knowledge of the theoretical initial cards dealt to the players and the dealer. The hit cards accepted by the player lie between the player's initial cards and the next previous set of initial cards in the sequence of collected cards 94. Where a hand has been split, there will be hit cards associated with each hand. The hit cards for the hand based on the player's second initial card will lie between that second initial card and the player's first initial card, while the hit cards for the hand based on the player's first initial card will lie between that first initial card and the next previous player's initial card. Thus, an inspection of the sequence of collected cards 94 (FIG. 15) allows the card game evaluation system 10 to determine the actual number of hit cards take by each player for each hand. For example, as illustrated in FIG. 15, a first player accepted one hit card, a second player accepted no hit cards, a third player accepted two hit cards and a dealer accepted no hit cards.

In step 640, the card game evaluation system 10 determines the composition of each theoretical hand for each player. The card game evaluation system 10 employs the initial sequence of card values 93 (FIG. 14) along with a knowledge of the number of cards (initial and hit cards) taken by each player for each hand to determine the theoretical hands. For example, the theoretical initial hand for each player is easily determined from the initial sequence of card values 93 (FIG. 14), a knowledge of the total number of players including the dealer, and the relative positions of the players with respect to one another, as explained above. The card game evaluation system 10 can employ the order of the players and the number of hit cards taken by each player to successively assign hit card values to the theoretical initial hands.

Figure 14:
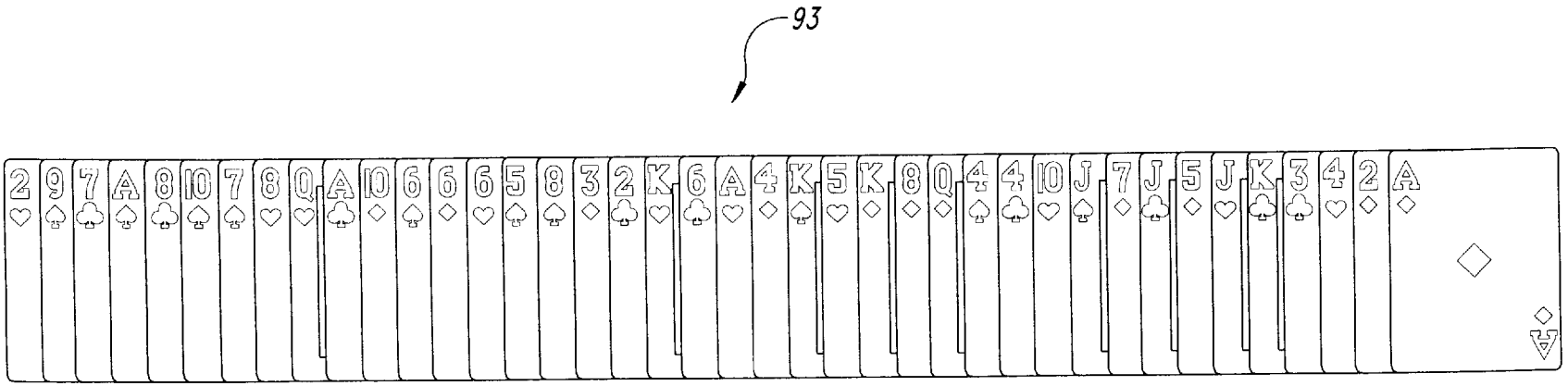
FIG. 14 is a schematic view of a generated sequence of playing card values, illustrated in the form of an ordered sequence of playing cards.

For example, in the example illustrated in FIG. 14, the first eight card values form four initial theoretical hands (i.e., two of hearts and eight of clubs; nine of spades and ten of spades; seven of clubs and seven of spades; and the ace of spade and the eight of hearts). The ninth card value (i.e., queen of hearts) is the first hit card. Where a first player takes a single hit card, the first player's theoretical hand would consist of the two of hearts, eight of clubs and the queen of hearts. Where a second player takes no hit cards, the second player's theoretical hand is composed of the nine and ten of spades. Where a third player follows by taking two hit cards, the third player's theoretical hand is composed of the seven of clubs, seven of spades, ace of clubs and ten of diamonds. Where a dealer then takes no hit cards, the dealer's theoretical hand is composed of the ace of spades and the eight of hearts.

The theoretical hands including initial cards and hit cards, and the outcome of each hand in this example are shown in table 2, below. The outcome is determined by comparing the value of each player's completed hand to the dealer's complete hand. The card game evaluation system 10 can automatically determine the value of the player's and dealer's hands, and can automatically determine the outcome of the games between the various players and the dealer.

TABLE 2

| | Round Outcome | | |
|---|---|---|---|
| | Initial Cards | Hit Cards | Outcome |
| Player 1 | 2 8<br>♥,♣ | Q<br>♥ | Win |
| Player 2 | 9 10<br>♠,♠ | | Push |
| Player 3 | 7 7<br>♣,♠ | A 10<br>♣, ♦ | Bust |
| Dealer | A 8<br>♠, ♥ | | |

In step 642, the card game evaluation system 10 compares the composition of the theoretical hand to composition of the actual hands for each player. The card game evaluation system 10 employs the sequence of collected cards 94 to determine the actual bands for each player. Where a first player took one hit card, a second player took no hit cards, a third player took hit cards and a dealer took no hit cards, the sequence of collected cards 94 appears as shown in FIG. 15.

In step 644, the card game evaluation system 10 notifies the dealer, casino, and/or other authorized personnel of discrepancies between the composition of the theoretical hand and the composition actual hand.

In optional step 646, the card game evaluation system 10 determines the theoretical value of each hand for each player. The theoretical value is based on the value assigned by rank, to the cards composing the theoretical hands based on the initial sequence of card values 93. In optional step 648, the card game evaluation system 10 determines the actual value for each hand of each player. The actual value is also based on the value assigned by rank, to cards composing the actual hands based on the sequence of collected cards 94. In optional step 650, the card game evaluation system 10 compares the theoretical value to the actual value for each hand of each player. In optional step 652, the card game evaluation system 10 notifies the dealer, casino and/or other authorized personnel of discrepancies between the theoretical value and the actual value. The method 630 terminates in step 654.

Figure 16:
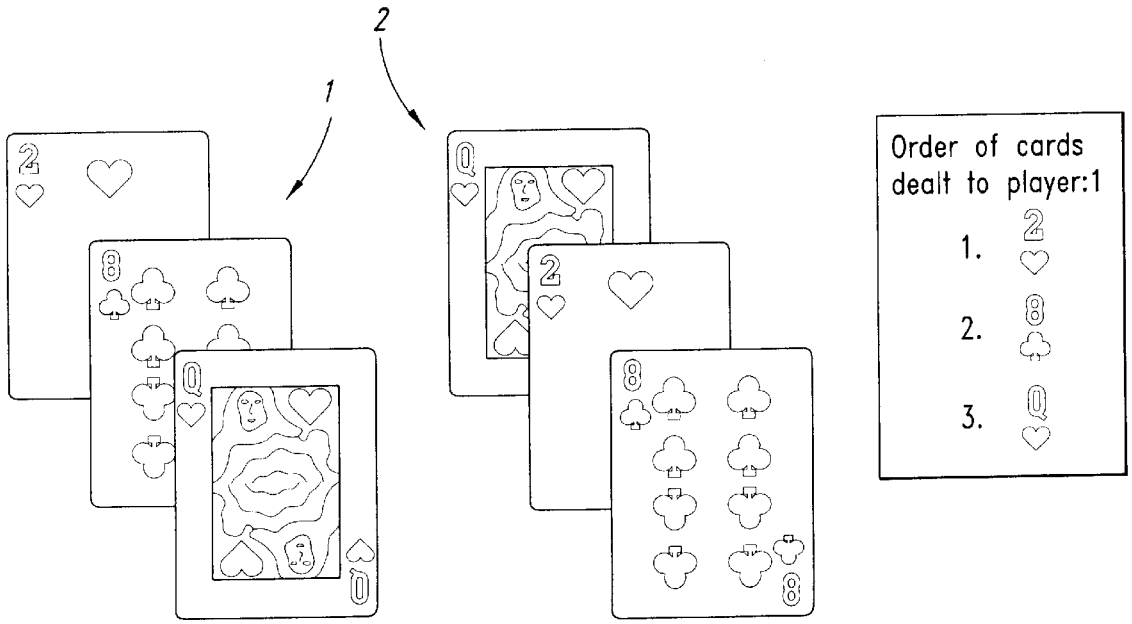
FIG. 16 is a schematic view contrasting a first player's complete hand in a game dealt from a card shoe with a game dealt by hand.

FIG. 16 shows that the order of cards in a player's completed hand will differ based on whether the cards are dealt from a shoe or by hand. The cards are dealt in the order shown in the table, two of hearts, eight of clubs and Queen of hearts. In a shoe dealt game the completed hand 1 has the order two of hearts, eight of clubs and Queen of hearts. In a hand dealt game the completed hand 2 has the order Queen of hearts, two of hearts, and eight of clubs.

Game Verification Without Pseudo-Random Sequence Generation

Figure 17:
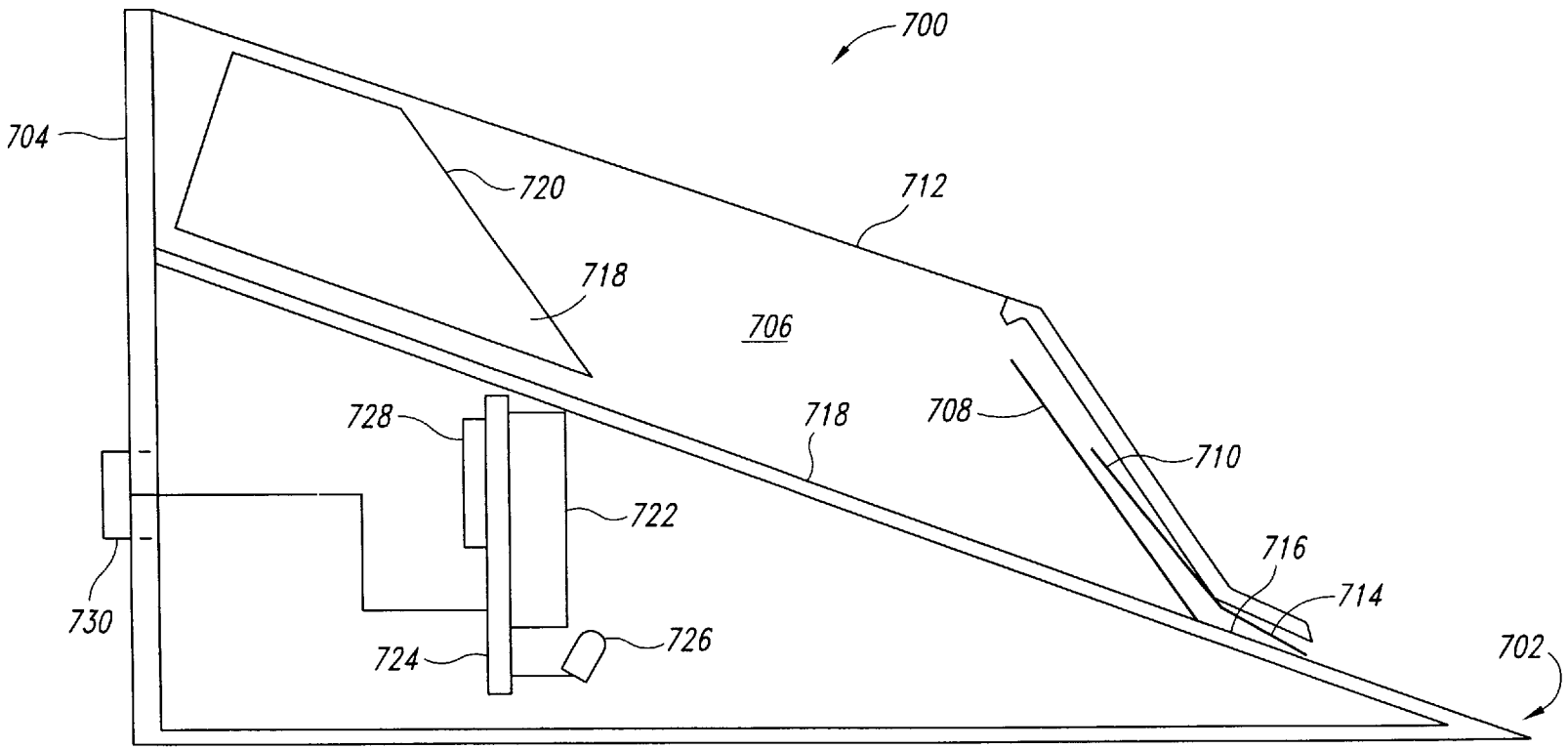
FIG. 17 is side elevational cross-sectional view of a card deck reader in a card shoe housing.

Card game verification can be achieved using a substantially different apparatus for determining the initial sequence of playing card values. FIG. 17 shows a card deck reader 700. The card deck reader 700 can be used to determine the initial or deck sequence of card values, prior to dealing. Thus, this embodiment is independent of the previously described embodiment which employs computational generation of a pseudo-random sequence of playing card values. This embodiment permits verification in games which are either manually shuffled or machine shuffled using a preexisting set of playing cards. Thus, this embodiment may be more readily acceptable to current casinos and players. In contrast, the previously discussed embodiment may achieve more through random distribution in the playing cards, and may handle a larger number of total decks from which the game with be dealt.

As illustrated, the card deck reader 700 takes the form of a card shoe 702 for use in card games dealt from a card shoe generation. Alternatively, the card deck reader 700 can take a hand-held form for games dealt by hand. The card shoe 702 includes a housing 704 forming a card receiver 706 for holding one or more decks of playing cards, represented by playing cards 708, 710. The housing 704 includes an opening 712 for providing access for loading the playing cards 708, 710 into the card receiver 706, and includes a slot 714 sized and dimensioned to allow the dealer to remove one card at a time, as illustrated by partially withdrawn playing card 710.

The housing 704 includes a sloped card support surface 716 for supporting the cards in the card receiver 706 such that the cards 708, 710 are slightly shifted or staggered with respect to one another, exposing an identifier such as a bar code symbol 160 (FIG. 5) on each of the playing cards 708, 710 when the card shoe 702 is on a horizontal playing surface. (The bar code symbol 160 may be printed along the short edges of the playing card as shown in FIG. 5 for example for playing hand held dealt games. Alternatively, the bar code symbol 160 may be printed along the long edges of the playing card, for example for card shoe dealt games.) A portion 718 of the sloped card support surface 716 aligned with the exposed symbols is transparent. The card shoe 702 includes a weighted slide 718 that biases the playing cards 708, 710 toward the slot 714. The weighted slide 718 includes a sloped surface 720 for further maintaining the shifted or staggered aspect of the playing cards 708, 710.

The card deck reader 700 has a reading mechanism such as an optical scanner, one or two-dimensional optical imager, or magnetic sensor capable of reading a unique identifier identifying each playing card in the card shoe. For example, a two-dimensional optical imager 722 can have a field-of-view aligned with the transparent portion 718 of the sloped card support surface 716. The imager 722 can be mounted on a circuit board 724, along with other electrical and electronic components such as a light source 726 for illuminating the exposed portions of the playing cards 708, 710, and/or image processing circuitry such a central processing unit (CPU), digital signal processors (DSP), and/or application-specific integrated circuit (ASIC), etc 728. The card deck reader 700 can include a data interface 730 for providing communications with other electronic components such as the host computing system 12 (FIG. 1), server 14, and/or the various components at the gaming table. The processing of the card identification data read from the playing cards 708, 710 can take place in the deck reader 700, the host computing system 12 and/or server computing system 14. Other card readers are of course possible, such as card readers described in above in reference to FIGS. 6–9, and in commonly assigned U.S. patent applications listed at the end of this specification.

Thus, the sequence of the cards from which the game will be dealt is known to the card game evaluation system 10 at the start of the game, before the playing cards are dealt. Once the initial order or deck sequence of playing card values is known, the automated wager monitoring system 10 can employ a process similar the process described above (FIGS. 13–16) for verifying the cards.

Although specific embodiments of and examples for the card distribution device and method of operating the same are described herein for illustrative purposes, various equivalent modifications can be made without departing from the spirit and scope of the invention, as will be recognized by those skilled in the relevant art. The teachings provided herein of the invention can be applied to any networked systems, including the World Wide Web portion of the Internet. The teachings can also employ standalone systems, and/or to combinations of standalone and networked card distribution devices 24 in the same gaming environment. The teachings can apply to any type of card game where a random distribution of playing cards is desired, such as baccarat, 5-card stud poker, Caribbean stud poker, Tai Gow poker, Hi/Low, and Let-It-Ride™. While the illustrated embodiments show networked and standalone embodiments, the invention is not limited to such, and one skilled in the art can easily adapt the teachings herein to further levels of wagering. The card interface device 24 can be used with a larger number of players. The card interface device 24 can be used in environments other than casinos, such as taverns, betting parlors, and even homes. Additionally, the methods described above may include additional steps, omit some steps, and perform some steps in a different order than illustrated.

The teachings can also be adapted to employ playing cards formed of "smart paper," a product developed by Xerox Palo Alto Research Center, of Palo Alto, Calif. The smart paper consists of a flexible polymer containing millions of small balls and electronic circuitry. Each ball has a portion of a first color and a portion of a second color, each portion having an opposite charge from the other portion. Applying a charge causes the balls to rotate within the polymer structure, to display either the first or the second color. Charges can be selectively applied to form different ones or groups of the balls to from the respective markings 154–160 on the playing cards 108. The markings 154–160 remain visible until another charge is applied.

Alternatively, the teachings can be adapted to employ color-changing inks such as thermochromatic inks (e.g., liquid crystal, leucodyes) which change color in response to temperature fluctuations, and photochromatic inks that respond to variations in UV light.

The various embodiments described above can be combined to provide further embodiments. All of the above U.S. patents, patent applications and publications referred to in this specification as well as commonly assigned U.S. patent applications Serial No. 60/130,368, filed Apr. 21, 1999; No. 09/474,858, filed Dec. 30, 1999, entitled "METHOD AND APPARATUS FOR MONITORING CASINO GAMING" (Atty. Docket No. 120109.401); No. 60/259,658, filed Jan. 4, 2001; Ser. No. 09/849,456, filed May 4, 2001, entitled METHOD, APPARATUS AND ARTICLE FOR VERIFYING CARD GAMES, SUCH AS BLACKJACK (Atty. Docket No. 120109.402); Ser. No. 09/790,480, filed Feb. 21, 2001, entitled "METHOD, APPARATUS AND ARTICLE FOR EVALUATING CARD GAMES, SUCH AS BLACKJACK" (Atty. Docket No. 120109.403); No. 60/300253, filed Jun. 21, 2001, entitled METHOD, APPARATUS AND ARTICLE FOR HIERARCHAL WAGERING (Atty. Docket No. 120109.404P1); and No. 60/296,866, filed Jun. 8, 2001, entitled "METHOD, APPARATUS AND ARTICLE FOR RANDOM SEQUENCE GENERATION AND PLAYING CARD DISTRIBUTION" (Atty. Docket No. 120109.406P1) are each incorporated herein by reference in their entirety. Aspects of the invention can be modified, if necessary, to employ systems, circuits and concepts of the various patents, applications and publications to provide yet further embodiments of the invention.

While the illustrated embodiment typically discusses decks of playing cards, some embodiments may employ a lesser or greater number of playing cards, or can employ playing cards and/or decks other than the conventional playing card decks (i.e., 52 cards with ranks 2–10, Jack, Queen, King, and Ace and with four suits, heats, diamonds, spades and clubs).

These and other changes can be made to the invention in light of the above detailed description. In general, in the following claims, the terms used should not be construed to limit the invention to the specific embodiments disclosed in the specification and the claims, but should be construed to include all card distribution devices and method that operate in accordance with the claims. Accordingly, the invention is not limited by the disclosure, but instead its scope is to be determined entirely by the following claims.

What is claimed is:

1. A method of verifying playing card games, comprising:

computationally generating a first pseudo-random sequence of playing card values;

reading an identifier from each of a number of playing cards forming a hand of playing cards;

determining an expected set of playing card values for the playing card hand based on the computationally generated first pseudo-random sequence of playing card values, a number of hands dealt and a relative position of the playing card hand in an order of dealing; and determining whether the identifiers read from each of the number of playing cards forming the hand of playing cards correspond to the expected set of playing card values for the playing card hand.

2. The method of claim 1, further comprising:

printing a set of markings on each of a plurality of playing cards including the number of playing cards forming the hand of playing cards, the markings corresponding to the respective ones of the playing card values; and dealing the printed playing cards to at least one player.

3. The method of claim 1 wherein reading an identifier from each of a number of playing cards forming a hand of playing cards includes one of optically reading markings on the playing cards and magnetically reading markings on the playing cards.

4. The method of claim 1, further comprising:

producing a notification if the identifiers read from each of the number of playing cards forming the hand of playing cards do not correspond to the expected set of playing card values for the playing card hand.

5. A computer-readable media, having instructions that cause a computer to evaluate a card game, by:

computationally generating a first pseudo-random sequence of playing card values;

reading an identifier from each of a number of playing cards forming a hand of playing cards;

determining an expected set of playing card values for the playing card hand based on the computationally generated first pseudo-random sequence of playing card values, a number of hands dealt and a relative position of the playing card hand in an order of dealing; and determining whether the identifiers read from each of the number of playing cards forming the hand of playing cards correspond to the expected set of playing card values for the playing card hand.

6. A method of verifying playing card games, comprising:

receiving a computationally generated first pseudo-random sequence of playing card values;

reading an identifier from each of a number of playing cards forming a hand of playing cards;

determining an expected set of playing card values for the playing card hand based on the computationally generated first pseudo-random sequence of playing card values, a number of hands dealt and a relative position of the playing card hand in an order of dealing; and determining whether the identifiers read from each of the number of playing cards forming the hand of playing cards correspond to the expected set of playing card values for the playing card hand.

7. The method of claim 6, further comprising:

printing a set of markings on each of a plurality of playing cards including the number of playing cards forming the hand of playing cards, the markings corresponding to the respective ones of the playing card values; and dealing the printed playing cards to at least one player.

8. The method of claim 6 wherein the computationally generated first pseudo-random sequence of playing card values is received over a networked communications channel from a remote source.

9. A computer-readable media, having instructions that cause a computer to evaluate a card game, by:

receiving a computationally generated first pseudo-random sequence of playing card values;

reading an identifier from each of a number of playing cards forming a hand of playing cards;

determining an expected set of playing card values for the playing card hand based on the computationally generated first pseudo-random sequence of playing card values, a number of hands dealt and a relative position of the playing card hand in an order of dealing; and determining whether the identifiers read from each of the number of playing cards forming the hand of playing cards correspond to the expected set of playing card values for the playing card hand.

10. A method of verifying playing card games, comprising:

receiving a computationally generated first pseudo-random sequence of playing card values;

receiving a set of identifiers, identifying each of a number of playing cards forming a hand of playing cards;

determining an expected set of playing card values for the playing card hand based on the computationally generated first pseudo-random sequence of playing card values, a number of hands dealt and a relative position of the playing card hand in an order of dealing; and determining whether the received identifiers identifying each of the number of playing cards forming the hand of playing cards correspond to the expected set of playing card values for the playing card hand.

11. The method of claim 10, further comprising:

printing a set of markings on each of a plurality of playing cards including the number of playing cards forming the hand of playing cards, the markings corresponding to the respective ones of the playing card values; and dealing the printed playing cards to at least one player.

12. The method of claim 10 wherein the set of identifiers identifying each of a number of playing cards forming a hand of playing cards is received over a networked communications channel from a remote source.

13. A computer-readable media, having instructions that cause a computer to evaluate a card game, by:

receiving a computationally generated first pseudo-random sequence of playing card values;

receiving a set of identifiers, identifying each of a number of playing cards forming a hand of playing cards;

determining an expected set of playing card values for the playing card hand based on the computationally generated first pseudo-random sequence of playing card values, a number of hands dealt and a relative position of the playing card hand in an order of dealing; and determining whether the received identifiers identifying each of the number of playing cards forming the hand of playing cards correspond to the expected set of playing card values for the playing card hand.

14. A method of verifying playing card games, comprising:

computationally generating a first pseudo-random sequence of playing card values;

receiving a set of identifiers, identifying each of a number of playing cards forming a hand of playing cards;

determining an expected set of playing card values for the playing card hand based on the computationally generated first pseudo-random sequence of playing card values, a number of hands dealt and a relative position of the playing card hand in an order of dealing; and determining whether the received identifiers identifying each of the number of playing cards forming the hand of playing cards correspond to the expected set of playing card values for the playing card hand.

15. The method of claim 14 wherein the set of identifiers identifying each of a number of playing cards forming a hand of playing cards is received over a networked communications channel from a remote source.

16. The method of claim 14 wherein the set of identifiers identifying each of a number of playing cards forming a hand of playing cards is received over a networked communications channel from a remote source, and further comprising:

transmitting a notification to the remote source if the identifiers read from each of the number of playing cards forming the hand of playing cards do not correspond to the expected set of playing card values for the playing card hand.

17. A method of verifying playing card distribution, comprising:

computationally generating a first pseudo-random playing card sequence from a first set of playing card values; and for each of a number of playing card hands, verifying that the cards forming the playing card hands having markings corresponding to respective ones of the playing card values dealt in an order matching at least a portion of the generated first pseudo-random playing card sequence.

18. The method of claim 17, further comprising:

printing a number of playing cards in an order matching one of a front-to-back direction and a back-to-front direction of the pseudo-random playing card sequence.

19. A computer-readable media, having instructions that cause a computer to evaluate a card game, by:

computationally generating a first pseudo-random playing card sequence from a first set of playing card values; and for each of a number of playing card hands, verifying that the cards forming the playing card hands having markings corresponding to respective ones of the playing card values dealt in an order matching at least a portion of the generated first pseudo-random playing card sequence.

20. A method of evaluating a card game, comprising:

automatically determining an identity of each of a number of playing cards forming a player's completed hand;

comparing the identity of each of the number of playing cards from the player's completed hand to an expected set of playing cards for the player's completed hand; and producing a notification if the identity of each of the number of playing card the player's completed hand does not match a respective playing card in the expected set of playing cards for the player's completed hand.

21. The method of claim 20 wherein automatically determining an identity of each of a number of playing cards forming a player's completed hand includes one of optically reading a set of optical markings from each of the playing cards forming the player's completed hand and magnetically reading a set of magnetic markings from each of the playing cards forming the player's completed hand.

22. The method of claim 20, further comprising:

determining an expected set of playing cards for the player's completed hand.

23. A method of evaluating a card game, comprising:

determining an expected playing card sequence for a plurality of playing cards from which a number of playing cards forming at least one actual completed hand for each of a number of players and a dealer are to be dealt;

reading an identifier from each of a number of playing cards forming a dealer's initial hand;

automatically determining an identity of each of a number of playing cards in an actual sequence of playing cards formed by each completed hand for each player and the dealer;

determining a number of players playing the card game from the number of playing cards preceding a first initial playing card of the dealer's initial hand in the expected playing card sequence;

for each of the number of players and the dealer, determining an identity of each of a number of playing cards forming an expected initial hand for the player and for the dealer from the expected playing card sequence and the determined number of players playing the card game;

for each of the number of players, determining a number of hit cards taken by the player, if any, from the number of cards between the player's initial hand and an next previous initial hand in the actual sequence of playing cards;

for the dealer, determining a number of hit cards taken by the dealer, if any, from the number of cards preceding the dealer's initial hand in the actual sequence of playing cards;

for each of the number of players and the dealer, determining an identity of each of the number of expected hit cards taken by the player, if any, from the expected sequence of playing cards, the number of hit cards taken by the player and a cumulative number of hit cards taken by the other players, if any, having initial hands preceding the player's initial hand in the actual sequence of playing cards, the expected hit cards forming a portion of an expected completed hand for the player along with the playing cards of the player's expected initial hand;

for the dealer, determining an identity of each of the number of expected hit cards taken by the dealer, if any, from the expected sequence of playing cards, the number of hit cards taken by the dealer and a cumulative number of hit cards taken by the players, the expected hit cards forming a portion of an expected completed hand for the dealer along with the playing cards of the dealer's expected initial hand;

for each of the number of players, comparing the player's actual completed hand with the player's expected completed hand; and for the dealer, comparing the dealer's actual completed hand with the dealer's expected completed hand.

24. The method of claim 23 wherein determining a playing card sequence for a plurality of playing cards from which the playing cards forming the player's completed hand is dealt includes reading markings from each of the number of playing cards before dealing the playing card.

25. The method of claim 23 wherein determining a playing card sequence for a plurality of playing cards from which the playing cards forming the player's completed hand is dealt includes computationally generating a pseudo-random sequence of the playing card values.

26. The method of claim 23 wherein determining a number of players playing the card game occurs after determining the expected playing card sequence for the plurality of playing cards and before dealing any hit cards to any of the number of players and the dealer.

27. A method of evaluating a card game, comprising:

determining an expected playing card sequence for a plurality of playing cards from which a number of playing cards forming at least one actual completed hand for each of a number of players and a dealer are to be dealt;

automatically determining an identity of each of a number of playing cards in an actual sequence of playing cards formed by each completed hand for each player and the dealer;

determining a number of players playing the card game;

for each of the number of players and the dealer, determining an identity of each of a number of playing cards forming an expected initial hand for the player and for the dealer from the expected playing card sequence and the determined number of players playing the card game;

for each of the number of players, determining a number of hit cards taken by the player, if any, from the number of cards between the player's initial hand and an next previous initial hand in the actual sequence of playing cards;

for the dealer, determining a number of hit cards taken by the dealer, if any, from the number of cards preceding the dealer's initial hand in the actual sequence of playing cards;

for each of the number of players and the dealer, determining an identity of each of the number of expected hit cards taken by the player, if any, from the expected sequence of playing cards, the number of hit cards taken by the player and a cumulative number of hit cards taken by the other players, if any, having initial hands preceding the player's initial hand in the actual sequence of playing cards, the expected hit cards forming a portion of an expected completed hand for the player along with the playing cards of the player's expected initial hand;

for the dealer, determining an identity of each of the number of expected hit cards taken by the dealer, if any, from the expected sequence of playing cards, the number of hit cards taken by the dealer and a cumulative number of hit cards taken by the players, the expected hit cards forming a portion of an expected completed hand for the dealer along with the playing cards of the dealer's expected initial hand;

for each of the number of players, comparing the player's actual completed hand with the player's expected completed hand; and for the dealer, comparing the dealer's actual completed hand with the dealer's expected completed hand.

28. The method of claim 27 wherein determining a number of players playing the card game includes detecting at least one of the number of hands of playing cards on a gaming table and the number of wagers on the gaming table.

29. A method of evaluating a card game, comprising:

automatically determining a deck sequence of playing card values for a plurality of playing cards from which a number of hands of playing cards of a card game are to be dealt, the deck sequence having sequentially ordered playing card values at integer numbered positions with respect to one another, starting at 1 for a playing card value corresponding to a first card to be dealt;

automatically determining a collected sequence of playing card values for a number of playing cards collected from a number of players and a dealer, including at least one complete hand for at least one player and at least one complete hand for a dealer;

determining a number of players in the card game;

for each of the players, determining an initial hand;

determining whether the initial hand was split;

if the initial hand was not split, determining a number of hits cards j for the complete hand, the number of hit cards being equal to a number of cards between a first card in the player's initial hand and a previous adjacent initial hand in the collected sequence of playing card values;

determining an expected hand for the player, composed of:

the playing card value at an $i^{th}$ position in the deck sequence of playing card values;

the playing card value at an $n+1+i^{th}$ position in the deck sequence of playing card values, where n is equal to a number of players in the card game; and the playing card value at a number j successive positions in the deck sequence of playing card values, starting at a position equal to 2n+2+ number of hit cards for all previous player's hands;

if the initial hand was split, determining a number of hits cards j for each of the complete hands, the number of hit cards for a first complete hand for the player being equal to a number of cards in the collected sequence of playing card values between a first card of the player's initial hand and a previous adjacent initial hand, and the number of hit cards for a second complete hand for the player being equal to a number of cards in the collected sequence of playing card values between a second card of the player's initial hand and the first card of the player's initial hand;

determining an expected first hand for the player, composed of:

the playing card value at an $i^{th}$ position in the deck sequence of playing card values;

the playing card value at a number j successive positions in the deck sequence of playing cards, starting at a position equal to 2n+2+ number of hit cards for all previous hands; and determining an expected second hand for the player, composed of:

the playing card value at an $n+1+i^{th}$ position in the deck sequence of playing card values, where n is equal to a number of active hands in the card game;

the playing card at a number j successive positions in the deck sequence of playing cards, starting at a position equal to 2n+2+number of hit cards for all previous hands; and comparing the complete hand to the respective expected hand for each hand.

30. The method of claim 29 wherein automatically determining a deck sequence of playing card values for a plurality of playing cards from which a number of hands of playing cards of a card game are to be dealt includes:

computationally generating a pseudo-random sequence of playing card values.

31. The method of claim 29 wherein automatically determining a deck sequence of playing card values for a plurality of playing cards from which a number of hands of playing cards of a card game are to be dealt includes:

reading markings corresponding to playing card values from each of a number of the plurality of playing cards from which the card game is to be dealt.

32. A method of verifying playing card games, comprising:

reading in sequence an identifier from each of a number of playing cards from which a card game will be dealt, determining a deck sequence of playing card values, the playing card values matching respective ones of the identifiers in order of the read sequence;

reading an identifier from each of a number of playing cards forming a hand of playing cards;

determining an expected set of playing card values for the playing card hand based on the deck sequence of playing card values, a number of hands dealt and a relative position of the playing card hand in an order of dealing; and determining whether the identifiers read from each of the number of playing cards forming the hand of playing cards correspond to the expected set of playing card values for the playing card hand.

33. The method of claim 32 wherein determining an expected set of playing card values for the playing card hand based on the deck sequence of playing card values, a number of hands dealt and a relative position of the playing card hand in an order of dealing includes:

determining an expected pair of playing card values for an initial hand based on the deck sequence of playing card values and a total number of players;

determining a number of expected hit cards for the hand from a number of playing card values in the deck sequence between successive initial hands; and determining a number of expected playing card values for the hit cards, if any, based on the deck sequence of playing card values, the number of expected hit cards for the hand, and a cumulative number of expected hit cards for previous hands, if any.

34. The method of claim 32 wherein reading an identifier includes one of optically reading markings on the playing cards and magnetically reading markings on the playing cards.

35. A system for verifying playing card distribution, comprising:

a processor configured to computationally generate a first pseudo-random sequence of playing card values; and a playing card reader to read identifiers from each of a number of playing cards forming at least one hand of playing cards, the playing card reader coupled to the processor to provide playing card identification information corresponding to the read identifiers to the processor, where the processor is further configured to verify that the cards forming the at least one playing card hand have markings corresponding to respective ones of the playing card values dealt in an order matching at least a portion of the computationally generated first pseudo-random sequence of playing card values.

36. The system of claim 35 wherein the processor and the playing card reader are located in a single housing.

37. The system of claim 35 wherein the processor and the playing card reader are located in a separate housings.

38. A system for verifying playing card distribution, comprising:

a playing card reader to read identifiers from each of a number of playing cards forming at least one hand of playing cards; and a processor couplable to receive a computationally generated first pseudo-random sequence of playing card values from a remote source, and coupled to the playing card reader to receive playing card identification information corresponding to the read identifiers, the processor being configured to verify that the cards forming the at least one playing card hand has markings corresponding to respective ones of the playing card values dealt in an order matching at least a portion of the received computationally generated first pseudo-random sequence of playing card values.

39. A system for verifying playing card distribution, comprising:

a playing card reader to read identifiers from each of a number of playing cards forming at least one hand of playing cards; and a processor couplable to receive a computationally generated first pseudo-random sequence of playing card values from a remote source, and coupled to receive playing card identification information from the playing card reader corresponding to the read identifiers, wherein the processor is configured to verify that the cards forming the playing card hands have markings corresponding to respective ones of the playing card values dealt in an order matching at least a portion of the generated first pseudo-random playing card sequence.

40. A system for verifying playing card distribution, comprising:

pseudo-random sequence generating means for computationally generating a first pseudo-random sequence of playing card values;

card reading means for reading identifiers from each of a number of playing cards forming at least one hand of playing cards; and verification means for verifying that the cards forming the playing card hand has markings corresponding to respective ones of the playing card values dealt in an order matching at least a portion of the computationally generated first pseudo-random sequence of playing card values.

41. A system for verifying playing card distribution, comprising:

communications means for receiving a computationally generated pseudo-random sequence of playing card values;

card reading means for reading identifiers from each of a number of playing cards forming at least one hand of playing cards; and verification means for verifying that the cards forming the playing card hand has markings corresponding to respective ones of the playing card values dealt in an order matching at least a portion of the received computationally generated first pseudo-random sequence of playing card values.

42. A system for verifying playing card distribution, comprising:

communications means for receiving a computationally generated pseudo-random sequence of playing card values and for receiving identifiers read from each of a number of playing cards forming at least one hand of playing cards; and verification means for verifying that the cards forming the playing card hand has markings corresponding to respective ones of the playing card values dealt in an order matching at least a portion of the received computationally generated first pseudo-random sequence of playing card values.

* * * * *